US012287140B2

(12) United States Patent
Cho et al.

(10) Patent No.: US 12,287,140 B2
(45) Date of Patent: Apr. 29, 2025

(54) REFRIGERATOR AND OPERATING METHOD THEREOF

(71) Applicant: LG ELECTRONICS INC., Seoul (KR)

(72) Inventors: Yongbum Cho, Seoul (KR); Dong Hwi Kim, Seoul (KR); Hyeonseong Lee, Seoul (KR); Sunghee Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 263 days.

(21) Appl. No.: 17/879,095

(22) Filed: Aug. 2, 2022

(65) Prior Publication Data

US 2023/0043230 A1 Feb. 9, 2023

(30) Foreign Application Priority Data

Aug. 3, 2021 (KR) ..... 10-2021-0101893

(51) Int. Cl.
*F25D 17/04* (2006.01)
*F25D 17/06* (2006.01)

(52) U.S. Cl.
CPC ..... *F25D 17/045* (2013.01); *F25D 17/065* (2013.01); *F25D 2700/12* (2013.01)

(58) Field of Classification Search
CPC ..... F25D 2700/12; F25D 2700/123; F25D 2700/14; F25D 17/045; F25D 17/065; F25D 21/002; F25D 21/04; F25D 21/08; F25D 2400/38
See application file for complete search history.

(56) References Cited

U.S. PATENT DOCUMENTS 6,116,029 A * 9/2000 Krawec ..... F25B 21/02 62/3.4
6,182,454 B1 * 2/2001 McNeilan ..... F24F 11/0008 62/185
7,174,734 B2 * 2/2007 Davern ..... F25D 17/045 236/101 R
7,623,752 B2 * 11/2009 Gally ..... G01M 3/186 385/147

(Continued)

FOREIGN PATENT DOCUMENTS

CN 206739725 12/2017
EP 1591734 A1 * 11/2005 ..... F25D 17/042

(Continued)

OTHER PUBLICATIONS

EP 1591734 translation (Year: 2005).*

(Continued)

*Primary Examiner* — Filip Zec
(74) *Attorney, Agent, or Firm* — KED & ASSOCIATES, LLP

(57) ABSTRACT

A refrigerator and a method of controlling an operation thereof are proposed. In the refrigerator and method thereof, heat control of heaters for preventing a damper from freezing is performed according to at least any one condition set in consideration of a room temperature and refrigerator internal humidity. Accordingly, consumption of power due to unnecessary heat generation of the heaters may be reduced, thereby improving the power consumption.

18 Claims, 21 Drawing Sheets

(56) References Cited

U.S. PATENT DOCUMENTS

| | | | | |
|---|---|---|---|---|
| 8,746,005 | B2 * | 6/2014 | Yoon | F25D 17/065 62/419 |
| 8,978,406 | B2 * | 3/2015 | Candeo | F25D 11/022 62/276 |
| 8,978,410 | B2 * | 3/2015 | Oh | F25D 11/022 62/515 |
| 10,914,502 | B2 * | 2/2021 | Tomohiko | F25D 11/02 |
| 2005/0126207 | A1 * | 6/2005 | Lee | F25D 17/065 62/408 |
| 2010/0107678 | A1 * | 5/2010 | Kim | F25D 17/065 700/282 |
| 2012/0253691 | A1 * | 10/2012 | Graf | G01N 27/223 702/24 |
| 2013/0042641 | A1 * | 2/2013 | Ryu | F25D 17/065 62/228.1 |
| 2013/0086928 | A1 * | 4/2013 | Cho | F25D 21/006 62/155 |
| 2019/0056165 | A1 * | 2/2019 | Im | F25D 23/025 |
| 2019/0271497 | A1 * | 9/2019 | Guanye | F25B 5/00 |
| 2022/0282901 | A1 | 9/2022 | Kim et al. | |

FOREIGN PATENT DOCUMENTS

| | | |
|---|---|---|
| EP | 4053478 | 9/2022 |
| JP | 2018-109489 | 7/2018 |
| KR | 10-1999-0009712 | 2/1999 |
| KR | 10-2001-0056077 | 7/2001 |
| KR | 10-0389399 | 6/2003 |
| KR | 10-2020-0095887 | 8/2020 |
| KR | 10-2020-0107390 | 9/2020 |

OTHER PUBLICATIONS

Extended European Search Report dated Mar. 2, 2023 issued in Application No. 22188143.6.

European Search Report dated Nov. 28, 2022 issued in EP Application No. 22188143.6.

* cited by examiner

FIG. 18

| | RT≤ 12.5℃ | 12.5℃<RT≤ 17℃ | 17℃<RT≤ 27℃ | 27℃<RT |
|---|---|---|---|---|
| R+F | OFF | OFF | OFF | OFF |
| R | ON | OFF | OFF | OFF |
| Comp. OFF | ON | OFF | OFF | OFF |

FIG. 19

| | RT≤ 13.5℃ | 12.5℃<RT≤ 18℃ | 17℃<RT≤ 28℃ | 27℃<RT |
|---|---|---|---|---|
| R+F | OFF | OFF | OFF | OFF |
| R | ON | OFF | OFF | OFF |
| Comp. OFF | ON | OFF | OFF | OFF |

| | RH≤35% | 35%<RH≤40% | 40%<RH≤50% | 50%<RH |
|---|---|---|---|---|
| R+F | OFF | OFF | OFF | OFF |
| R | OFF | ON(2min.) | ON(3min.) | ON(4min.) |
| Comp. OFF | OFF | ON(2min.) | ON(3min.) | ON(4min.) |

REFRIGERATOR AND OPERATING METHOD THEREOF

CROSS-REFERENCE TO RELATED APPLICATION

The present application claims priority to Korean Patent Application No. 10-2021-0101893, filed in Korea on Aug. 3, 2021, the entire contents of which is incorporated herein for all purposes by this reference.

BACKGROUND

1. Field

The present disclosure relates to a refrigerator and a method of controlling an operation thereof, the refrigerator including heaters for preventing freezing of a damper positioned in a supply duct in consideration of humidity inside storage compartments.

2. Background

A refrigerator is a home appliance that provides long-term storage of objects to be stored by using cold air, and there are provided at least one or more storage compartments in which the objects to be stored are stored.

The storage compartments may include: a freezing compartment for frozen storage of objects to be stored and a refrigerating compartment for refrigerated storage of objects to be stored, and may include two or more freezing compartments or two or more refrigerating compartments.

In addition, the freezing compartment and the refrigerating compartment may be formed to be partitioned vertically or horizontally with a partition wall interposed therebetween. For example, in a case of a double-door refrigerator, a freezing compartment on one side and a refrigerating compartment on the other side are partitioned with a partition wall interposed therebetween.

In addition, the refrigerating compartment and the freezing compartment are supplied with cold air generated by a refrigeration system, and are controlled to maintain a temperature range between an upper limit reference temperature (NT+Diff) and a lower limit reference temperature (NT−Diff) on the basis of each set reference temperature (NT; Noth). For example, when a temperature of any one storage compartment is higher than the upper limit reference temperature, a compressor is operated to supply cold air to the corresponding storage compartment, and when a temperature of any one storage compartment is lower than the lower limit reference temperature, the operation of the compressor is stopped to block the cold air supplied into the corresponding storage compartment.

In particular, in a case of a refrigerator that performs temperature control of a refrigerating compartment and a freezing compartment by using one evaporator, there is provided a cold air duct that guides at least a portion of the cold air supplied to the freezing compartment (or the refrigerating compartment) to be selectively supplied to the refrigerating compartment (or the freezing compartment), and the cold air duct is configured to be opened and closed with a damper. That is, at least the portion of the cold air that has passed through the evaporator through the opening or closing operation of the cold air duct by the damper is allowed to be selectively supplied to the freezing compartment or the refrigerating compartment.

Meanwhile, since the damper exists in a storage compartment having high humidity, there is a risk of freezing, and accordingly, in the related art, various structures for preventing the damper from freezing are provided.

For example, in a case of Korean Patent Application Publication No. 10-1999-009712 (Related Art 1), a heater is provided between two baffles to generate heat for a preset time when door closing of a refrigerator is detected, whereby it is intended to prevent freezing of a damper.

However, in the case of the related art 1 described above, since an embodiment is configured to operate when the door closing of the refrigerator is detected regardless of a high room temperature, excessive temperature rise in a refrigerating compartment and an increase in power consumption are caused due to unnecessary heat generation of the heater.

In addition, in the above-described related art 1, since the heater is configured to operate only by the opening or closing of the refrigerator door, there occurs a case where the heater does not operate for a long time when the refrigerator door is not opened or closed, and accordingly, there is a problem in that freezing may occur.

In addition, in a case of Korean Patent Application Publication No. 2001-0056077 (Related art 2), since a cold air inlet is provided in a control box positioned inside a refrigerating compartment, there is a disadvantage in that a space in the refrigerating compartment is reduced as much as the space of the corresponding control box. In particular, in a case of the refrigerating compartment, there is a problem of having an inevitable phenomenon in which when the heater generates heat, an ambient temperature rises easily, thereby affecting refrigeration.

Recently, a structure of a refrigerator has been provided wherein a damper is positioned in a freezing compartment, and a refrigerating compartment and a region where the damper is installed are connected to each other by a flow path duct, so as to enable transfer of cold air. In this regard, the structure is as disclosed in Korean Patent Application Publication No. 10-2020-0095887 (Related art 3) and Korean Patent Application Publication No. 10-2020-0107390 (Related art 4).

In the case of the related art 3 and the related art 4, as the damper provided to maintain a temperature difference between the refrigerating compartment and a refrigerating compartment duct is arranged in the freezing compartment, the problem of having the reduced space of the refrigerating compartment of the related art 2 may be prevented.

However, in the related art 3 and related art 4 described above, there is a problem in that freezing occurs in a connection region between a damper housing (i.e., a first unit) provided to allow the damper of the freezing compartment duct (i.e., a grill assembly for the freezing compartment) to be installed and a supply duct (i.e., a second unit) configured to connect the damper housing to the refrigerating compartment duct (i.e., a grill assembly for the refrigerating compartment).

Naturally, in the related art 3 and the related art 4, the ice may be defrosted through a method of forcibly increasing the temperature of the refrigerating compartment, and also operation control may be performed in the supply duct periodically (or intermittently) to defrost the ice.

However, in the above-described defrosting method, there may occur a case where the freezing of the damper is unable to be accurately resolved, and when frequent defrosting is performed in order to prevent the freezing of the damper, there may occur a problem that consumption of power is large, thereby adversely affecting the power consumption.

That is, the risk of freezing of the damper may vary depending on a room temperature condition or a refrigerator internal humidity condition. However, conventionally, since only defrosting of an evaporator is considered without considering each of the above conditions, the defrosting to remove the freezing of the damper is not performed in a timely manner.

Accordingly, a new structure and a control method thereof capable of reducing the consumption of power while preventing the above-described damper from freezing are recently required.

DOCUMENTS OF RELATED ART (Patent Document 0001) Korean Patent Application Publication No. 10-1999-009712

(Patent Document 0002) Korean Patent Application Publication No. 2001-0056077

(Patent Document 0003) Korean Patent Application Publication No. 10-2020-0095887

(Patent Document 0004) Korean Patent Application Publication No. 10-2020-0107390.

BRIEF DESCRIPTION OF THE DRAWINGS

Embodiments will be described in detail with reference to the following drawings in which like reference numerals refer to like elements, and wherein:

FIGS. 18 and 19 are state views illustrating operation states of respective heaters on the basis of room temperature conditions for the defrosting operation for the damper of the refrigerator according to the exemplary embodiment of the present disclosure;

DETAILED DESCRIPTION

Hereinafter, a preferred exemplary embodiment of a refrigerator and a method of controlling an operation thereof according to the present disclosure will be described with reference to the accompanying FIGS. 1 to 23.

In the refrigerator and the method of controlling the operation thereof according to the exemplary embodiment of the present disclosure, heaters 610 and 620 configured to provide heat to a supply duct 400 or a damper 520 are allowed to selectively generate the heat according to a room temperature and refrigerator internal humidity, so as to reduce consumption of power.

The refrigerator from among the refrigerator and the method of controlling the operation thereof according to the exemplary embodiment of the present disclosure will be described in more detail for each component as follows.

Figure 1:
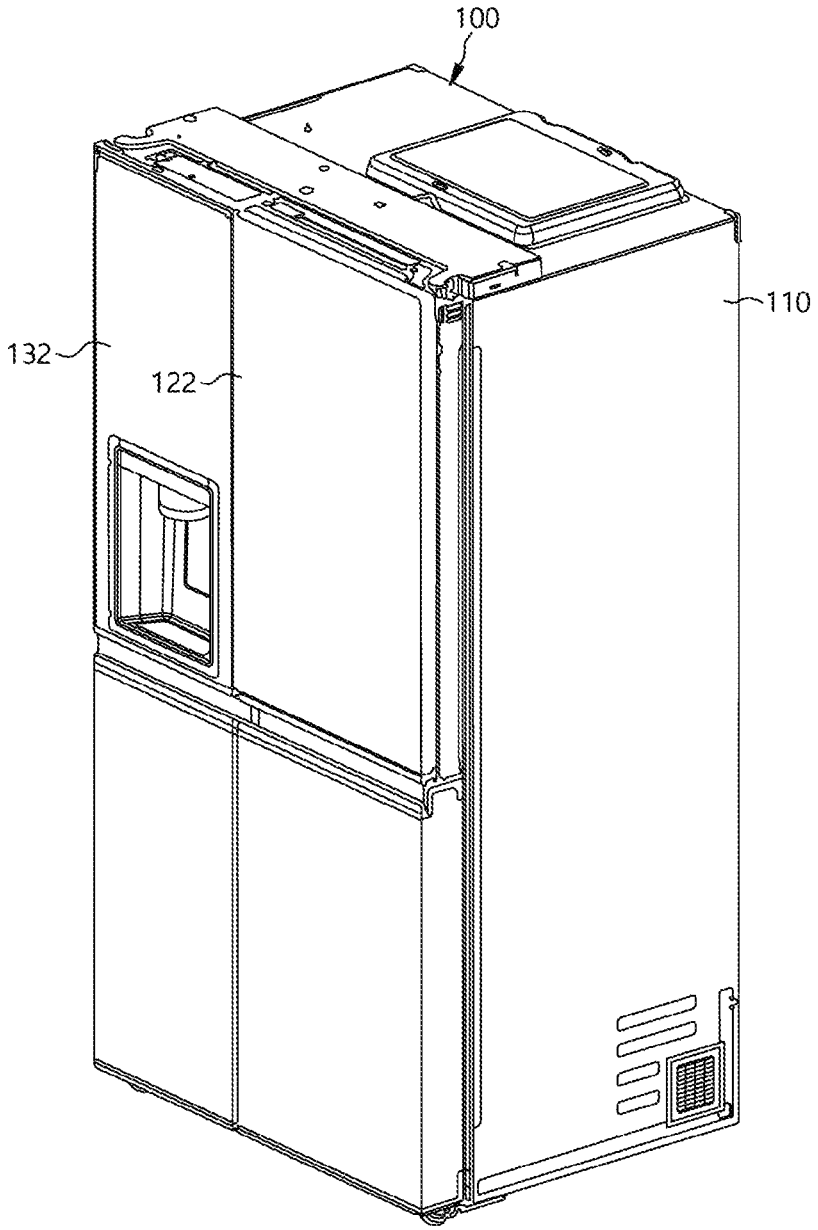
FIG. 1 is an external perspective view of a refrigerator according to an exemplary embodiment of the present disclosure.
Figure 2:
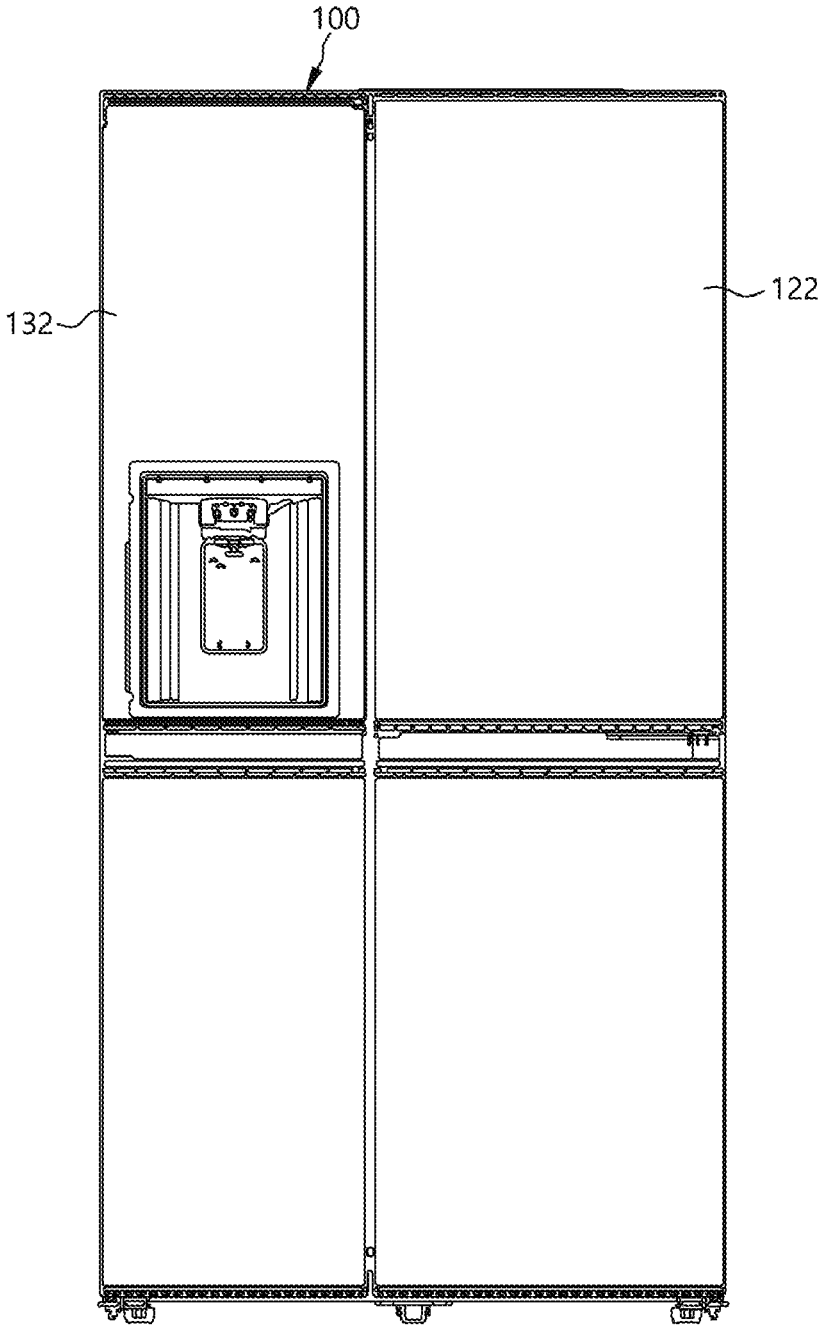
FIG. 2 is a front view illustrating an exterior shape of the refrigerator according to the exemplary embodiment of the present disclosure.
Figure 3:
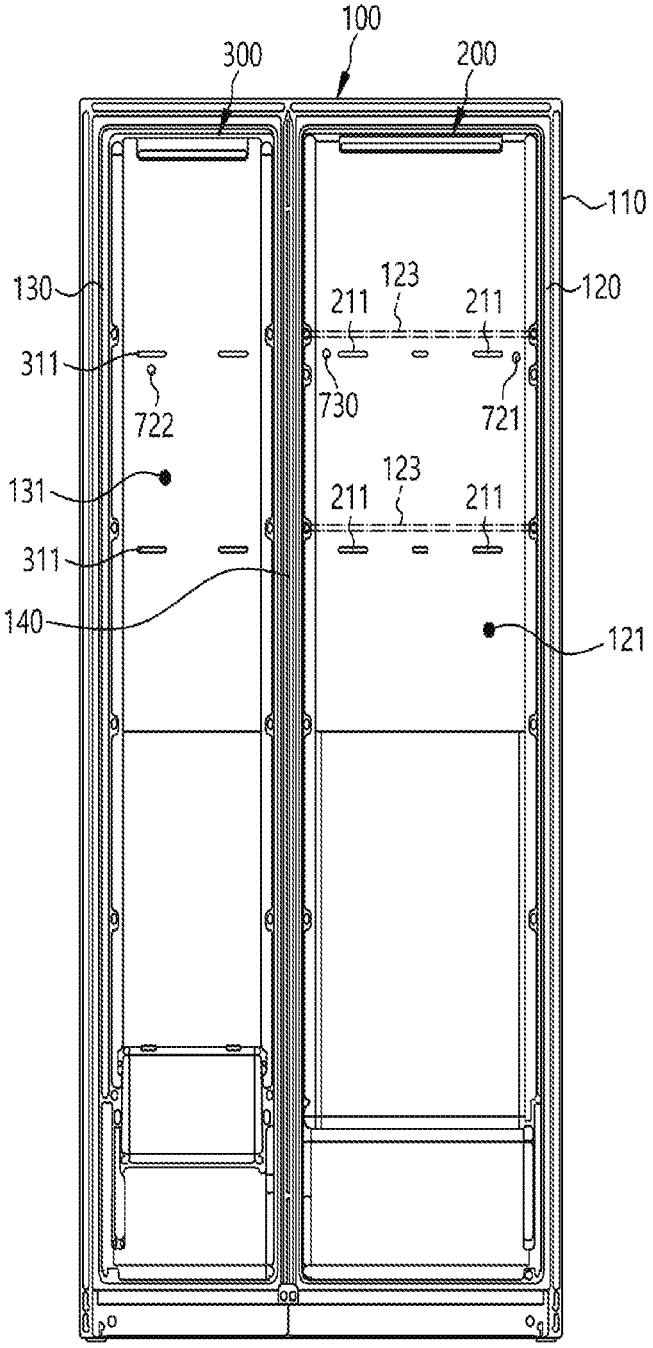
FIG. 3 is a front view illustrating an interior shape of the refrigerator according to the exemplary embodiment of the present disclosure.

In the accompanying views, FIG. 1 is an external perspective view of the refrigerator according to the exemplary embodiment of the present disclosure, FIG. 2 is a front view illustrating an exterior shape of the refrigerator according to the exemplary embodiment of the present disclosure, and FIG. 3 is a front view illustrating an interior shape of the refrigerator according to the exemplary embodiment of the present disclosure.

As shown in these views, the refrigerator according to the exemplary embodiment of the present disclosure may include a refrigerator body 100.

As shown in the accompanying FIG. 3, the refrigerator body 100 may be configured to include: an outer case 110 forming an outer body; and inner cases 120 and 130 positioned in the outer case 110.

Here, a plurality of inner cases 120 and 130 is provided to respectively form storage compartments 121 and 131. That is, each of the inner cases 120 and 130 is formed as a box body open to a front thereof, so as to form the respective storage compartments 121 and 131 for storing an object to be stored therein. Naturally, although not shown, the refrigerator body 100 may be formed of only either the outer case 110 or the inner cases 120 and 130.

Such a refrigerator body 100 is configured to include a first storage compartment 121 on one side and a second storage compartment 131 on the other side, with a partition wall 140 interposed therebetween. For example, while having the partition wall 140 interposed therebetween, the first inner case 120 configured to provide the first storage compartment 121 and the second inner case 130 configured to provide the second storage compartment 131 are respectively provided on one side and the other side.

The two inner cases 120 and 130 may be respectively provided on left and right sides of the refrigerator body 100, or may be respectively provided on upper and lower sides of the refrigerator body 100. For example, as shown in FIG. 3, when the refrigerator body 100 is viewed from the front, the first storage compartment 121 of the first inner case 120 may be positioned on the right side, and the second storage compartment 131 of the second inner case 130 may be positioned on the left side.

The second storage compartment 131 is maintained at a lower temperature than that of the first storage compartment 121. For example, the second storage compartment 131 may be a freezing compartment, and the first storage compartment 121 may be a refrigerating compartment.

In addition, doors 122 and 132 are respectively positioned on open front surfaces of the inner cases 120 and 130, so as to selectively open and close the respective storage compartments 121 and 131. In this case, the doors 122 and 132 may be rotary doors or drawer-type doors.

Next, the refrigerator according to the exemplary embodiment of the present disclosure may include a first grill assembly 200.

The first grill assembly 200 is positioned at the rear of the first inner case 120, and serves to guide the flow of cold air supplied into the first storage compartment 121.

Figure 4:
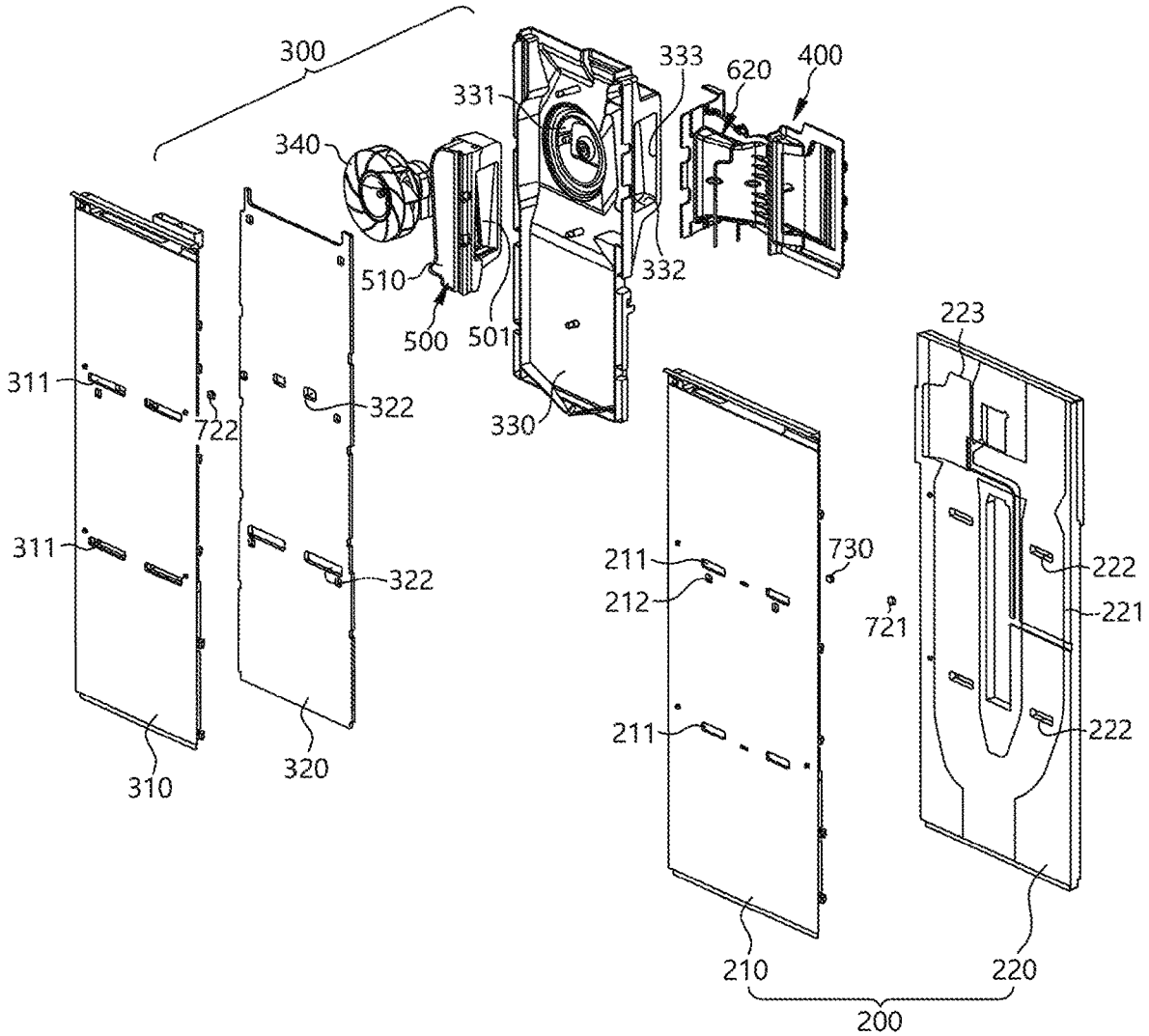
FIG. 4 is an exploded perspective view illustrating a structure and a coupling relationship of each grill assembly, a damper assembly, and a supply duct of the refrigerator according to the exemplary embodiment of the present disclosure.

As shown in the accompanying FIG. 4, the first grill assembly 200 may be configured to include: a first grill pan 210 positioned to be exposed to the first storage compartment 121; and a first duct plate 220 coupled to the rear of the first grill pan 210.

Here, a plurality of first cold air outlets 211 configured to discharge cold air to the first storage compartment 121 may be formed in the first grill pan 210, and a cold air flow path 221 configured to supply the cold air to each first cold air outlet 211 may be formed in the first duct plate 220.

In addition, a plurality of first communication holes 222 coincident with the respective first cold air outlets 211 may be formed in the first duct plate 220, and the cold air flow path 221 may be formed to pass through each first communication hole 222. In this case, the cold air flow path 221 may be formed in a concave shape on a rear surface of the first duct plate 220 or may be formed in the first duct plate 220.

In addition, a supply hole 223 configured to receive supply of cold air from the supply duct 400 is formed on one side of the rear surface of the first duct plate 220, and the cold air flow path 221 is formed to communicate with the supply hole 223.

Accordingly, the cold air delivered to the supply duct 400 may pass through the supply hole 223 and flow into the cold air flow path 221, and then may be supplied into the first storage compartment 121 by sequentially passing through each of the first communication holes 222 and each of the first cold air outlets 211 while flowing along the cold air flow path 221.

Next, the refrigerator according to the exemplary embodiment of the present disclosure may include a second grill assembly 300.

The second grill assembly 300 is positioned at the rear inside the second inner case 130, and serves to guide the flow of cold air supplied into the second storage compartment 131.

Figure 5:
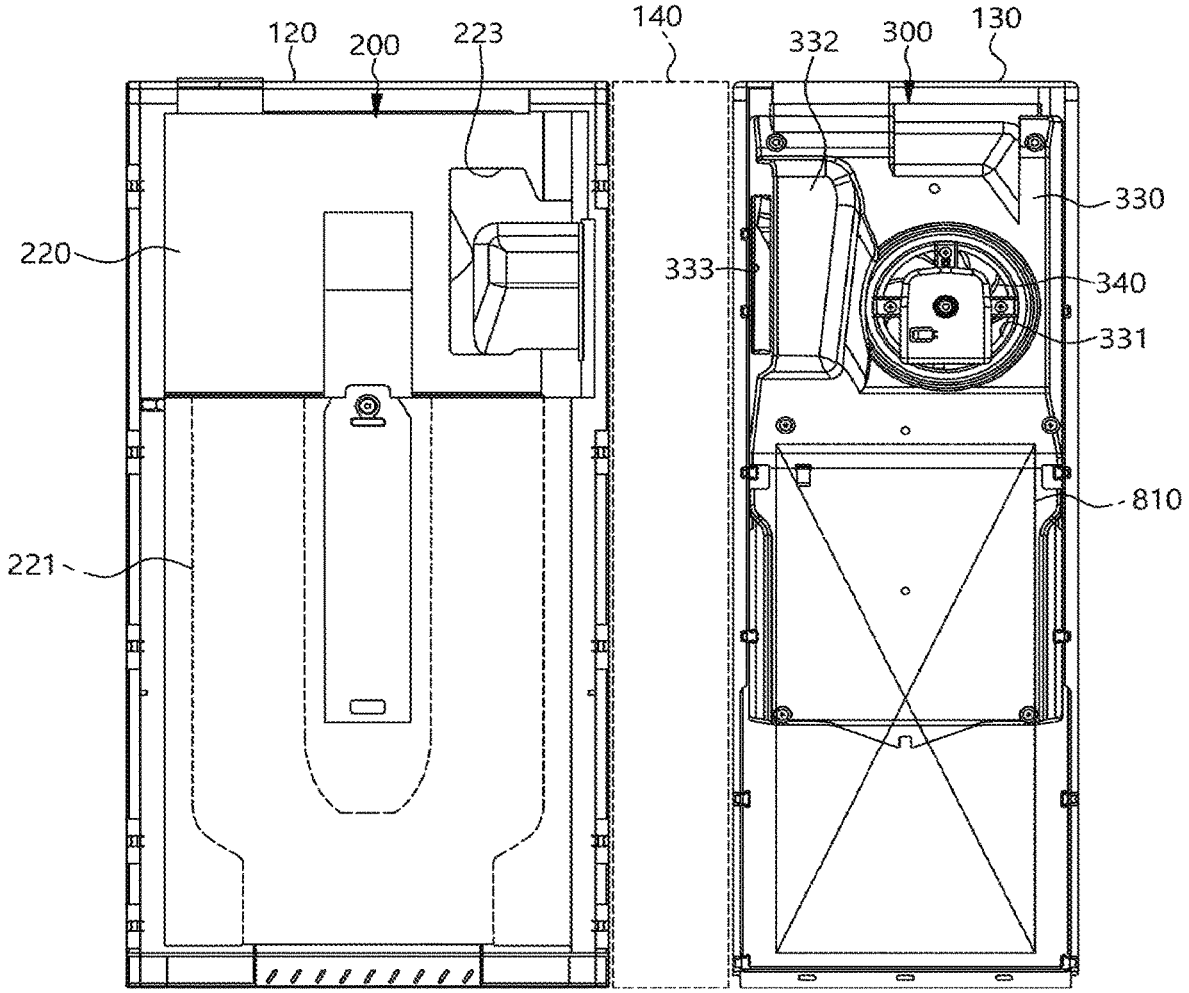
FIG. 5 is a state view, viewed from a rear side, illustrating each grill assembly of the refrigerator according to the exemplary embodiment of the present disclosure.
Figure 6:
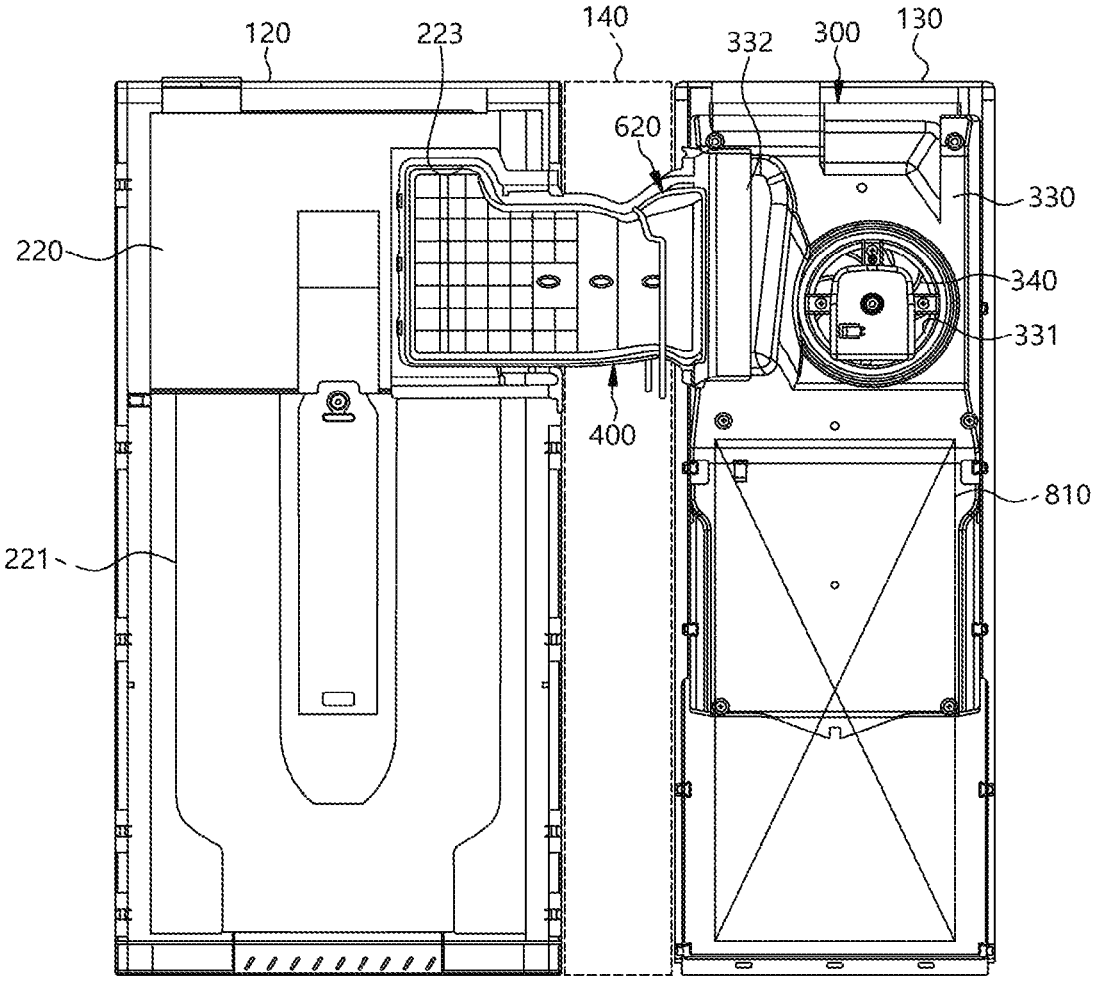
FIG. 6 is a state view illustrating a state in which the supply duct is installed in each grill assembly of the refrigerator according to the exemplary embodiment of the present disclosure.
Figure 7:
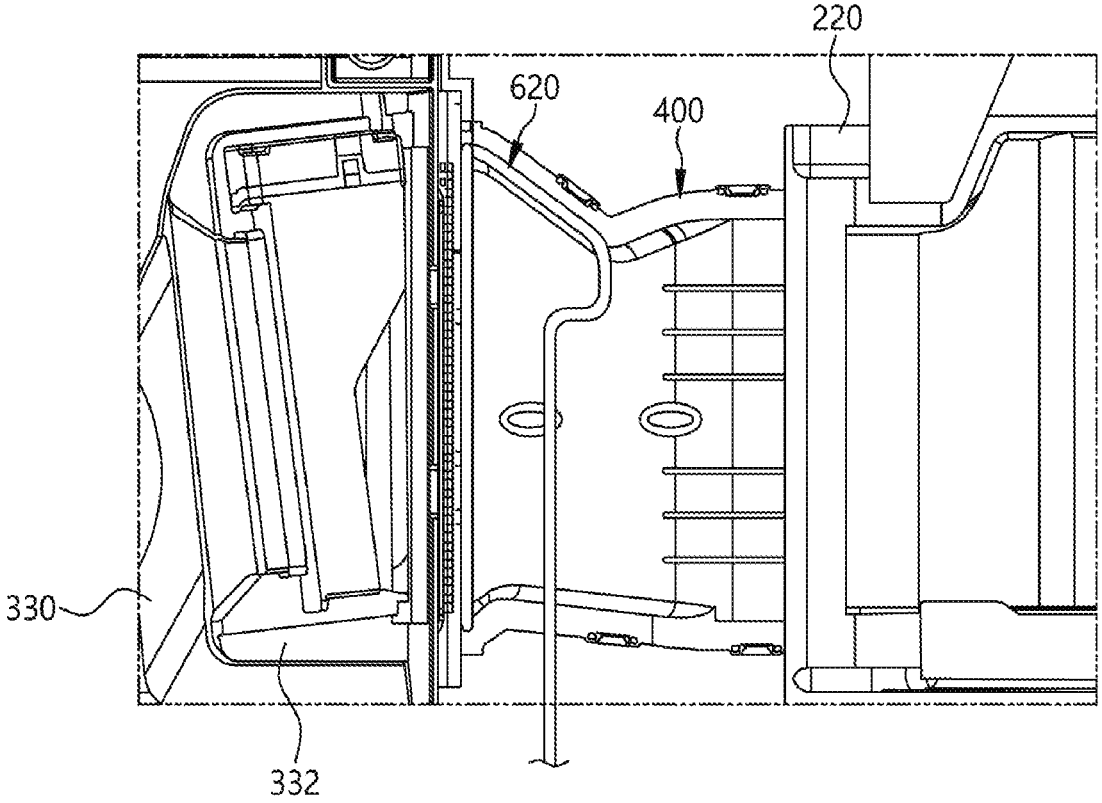
FIG. 7 is a main part state view illustrating the supply duct of the refrigerator and a structure where a second heater is installed in the supply duct according to the exemplary embodiment of the present disclosure.

As shown in the accompanying FIGS. 4 and 5, the second grill assembly 300 may be configured to include: a second grill pan 310 positioned to be exposed to the second storage compartment 131; a second duct plate 320 coupled to a rear of the second grill pan 310; a shroud 330 coupled to the rear of the second duct plate 320; and a blowing fan 340 installed between the second duct plate 320 and the shroud 330.

Here, a plurality of second cold air outlets 311 configured to discharge cold air to the second storage compartment 131 may be formed in the second grill pan 310, and a cold air flow path (not shown) configured to supply the cold air to each second cold air outlet 311 may be formed in the second duct plate 320.

In addition, a plurality of second communication holes 322 coincident with the respective second cold air outlets 311 is formed in the second duct plate 320, and the cold air flow path is formed to pass through each of the second communication holes 322. In this case, the cold air flow path may be formed in a concave shape on a rear surface of the second duct plate 320 or may be formed in the second duct plate 320.

In addition, a cold air inlet hole 331 is formed in the shroud 330 through which cold air passing through an evaporator 810 is introduced.

In addition, a mounting part 332 configured to mount a damper assembly 500 is formed on a side of the shroud 330, the side being opposite to the first grill assembly 200. In this case, the mounting part 332 is formed concave from a front surface (i.e., an opposite surface of the second duct plate) of the shroud 330 so that the damper assembly 500 may be accommodated.

In addition, an exposure hole 333 through which a passing flow path 501 of the damper assembly 500 installed in the mounting part 332 is exposed is formed, among sidewall surfaces of the shroud 330, on a sidewall surface of a region where the mounting part 332 is formed.

Next, the refrigerator according to the exemplary embodiment of the present disclosure may include a supply duct 400.

The supply duct 400 serves to supply at least a portion of cold air guided to the second grill assembly 300 to the first grill assembly 200.

Referring to the accompanying views shown in FIGS. 6 to 14, the supply duct 400 is formed of a duct having a supply flow path 401 formed in the duct. In this case, one end of the supply duct 400 is connected to the first grill assembly 200, and the other end of the supply duct 400 is connected to the second grill assembly 300.

Specifically, one end of the supply duct 400 is formed to cover the supply hole 223 formed on the rear surface of the first grill assembly 200, and an outlet 411 configured to supply cold air to the supply hole 223 is formed at a region coincident with the supply hole 223. In this case, the outlet 411 may be a region of the supply passage 401, the region being a side where cold air flows out.

In addition, the other end of the supply duct 400 is formed to cover an exposed hole 333 formed on a side surface of the second grill assembly 300, and an inlet 412 (See the accompanying FIG. 12) configured to receive supply of cold air from the exposed hole 333 is formed at a region coincident with the exposed hole 333. In this case, the inlet 412 may be a region of the supply passage 401, the region being a side where the cold air is introduced.

In addition, the supply duct 400 may be formed as a duct made of a single piece, or may be formed as a duct made by coupling two or more plurality of members to each other.

As an example, the supply duct 400 according to the exemplary embodiment of the present disclosure is formed by coupling a body part 410 and a cover part 420 to each other.

Here, the body part 410 is a part formed to have an open outer surface while being positioned in between on respective sides, facing each other, of the two grill assemblies 200 and 300, and the cover part 420 is a part formed to cover the open outer surface of the body part 410.

In particular, the inlet 412 of the supply duct 400 is formed by coupling the body part 410 and the cover part 420 to each other, and the outlet 411 of the supply duct 400 is formed in the body part 410.

Next, the refrigerator according to the exemplary embodiment of the present disclosure may include a damper assembly 500.

The damper assembly 500 serves to selectively open or block the supply of cold air from the second grill assembly 300 toward the supply duct 400.

For example, during a cooling operation for the first storage compartment 121, the damper assembly 500 opens the supply duct 400, so as to cause at least a portion of cold air introduced into the second grill assembly 300 to be supplied to the first storage compartment 121. During a cooling operation for the second storage compartment 131, the damper assembly 500 closes the supply duct 400, so as to cause the cold air introduced into the second grill assembly 300 to be supplied to the second storage compartment 131.

Naturally, during the cooling operation of the first storage compartment 121, a substantially simultaneous operation in which cold air is also supplied to the second storage compartment 131 is performed, and during the cooling operation of the second storage compartment 131, a standalone operation in which the cold air is supplied only to the second storage compartment 131 is performed.

Figure 8:
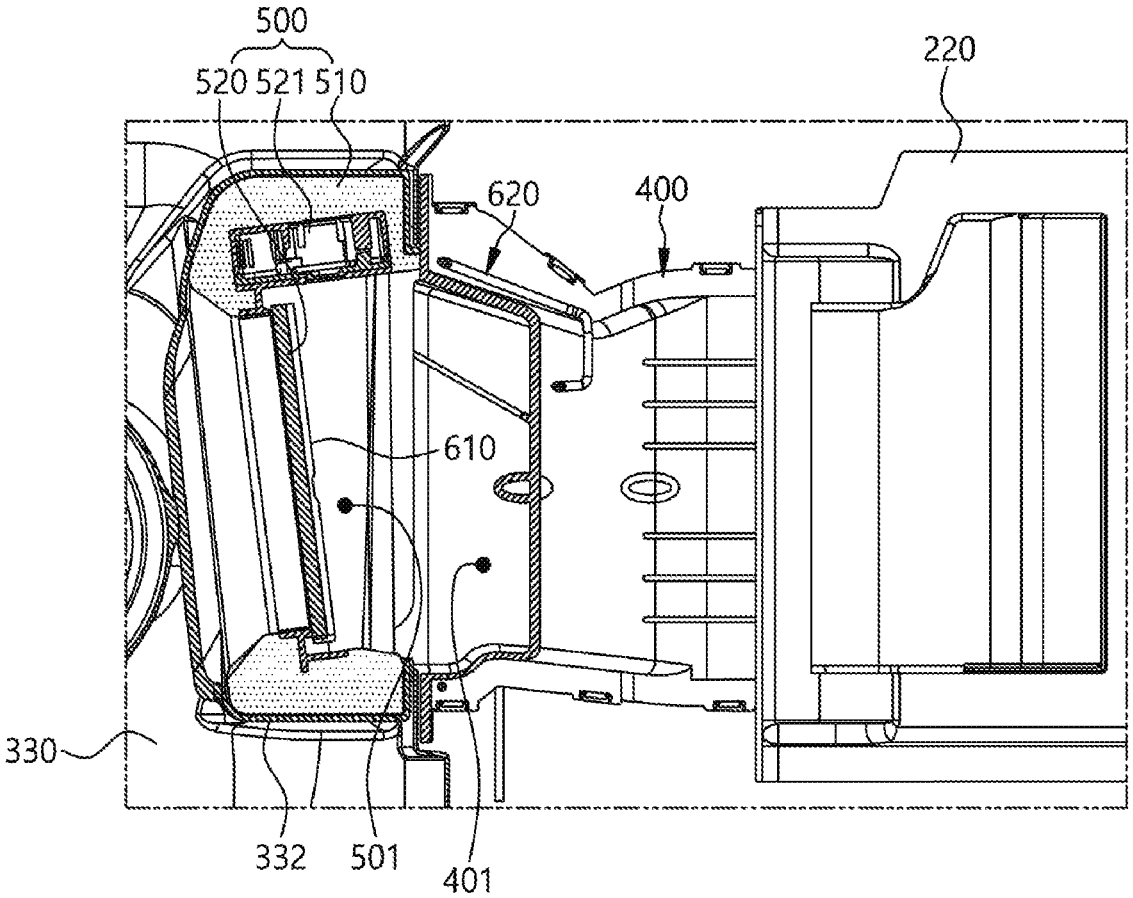
FIG. 8 is a main part cross-sectional view illustrating the supply duct of the refrigerator and the structure where the second heater is installed in the supply duct according to the exemplary embodiment of the present disclosure.
Figure 9:
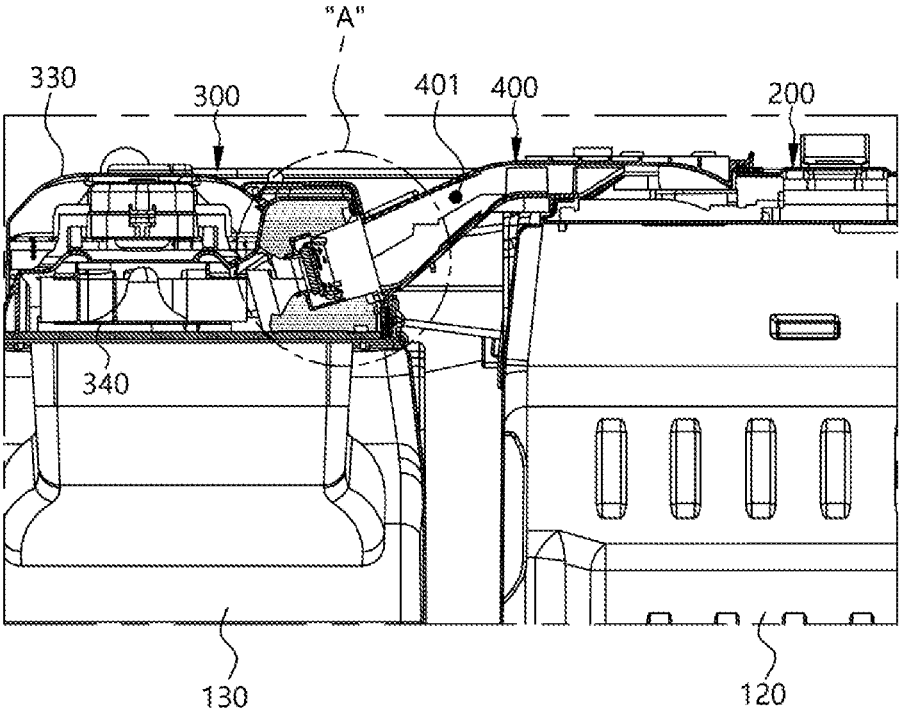
FIG. 9 is a main part sectional view illustrating a state viewed in a plane and in which the supply duct of the refrigerator is installed according to the exemplary embodiment of the present disclosure.
Figure 10:
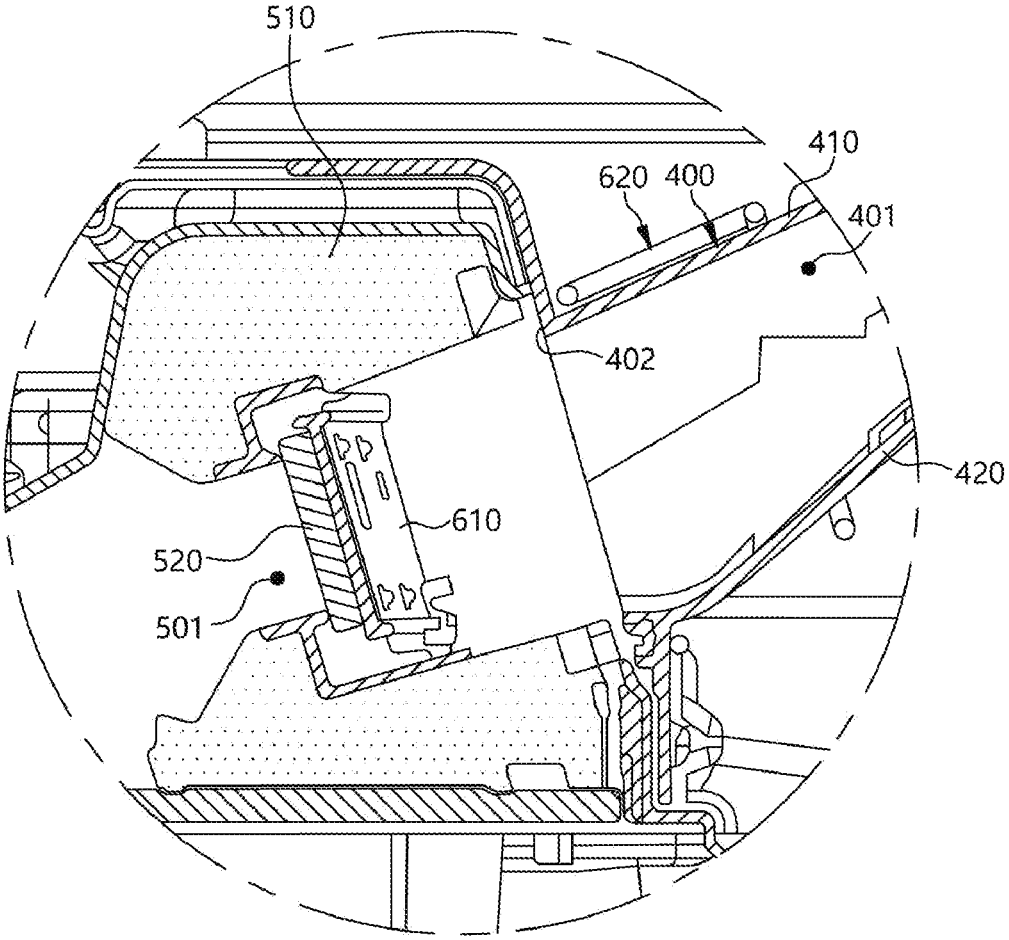
FIG. 10 is an enlarged view illustrating "A" part of FIG. 9.
Figure 11:
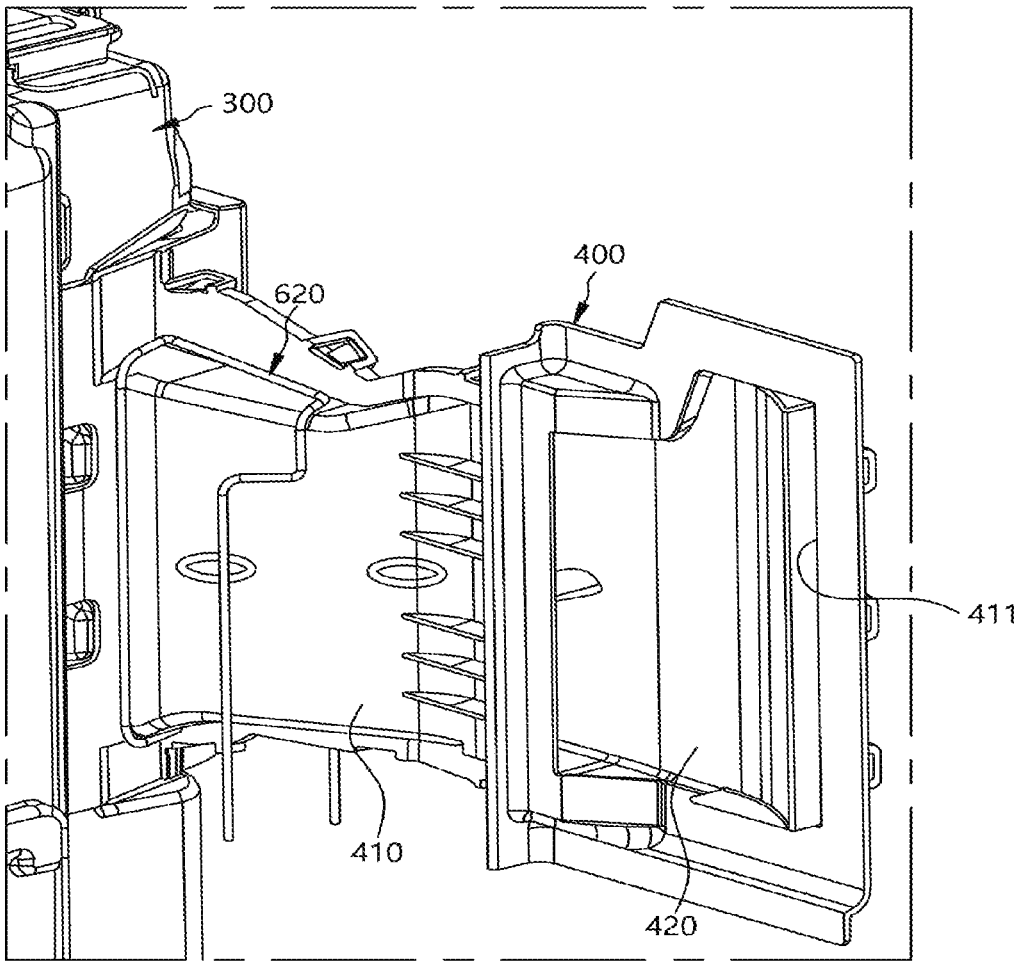
FIG. 11 is a perspective view illustrating a state in which the supply duct of the refrigerator is installed according to the exemplary embodiment of the present disclosure.
Figure 12:
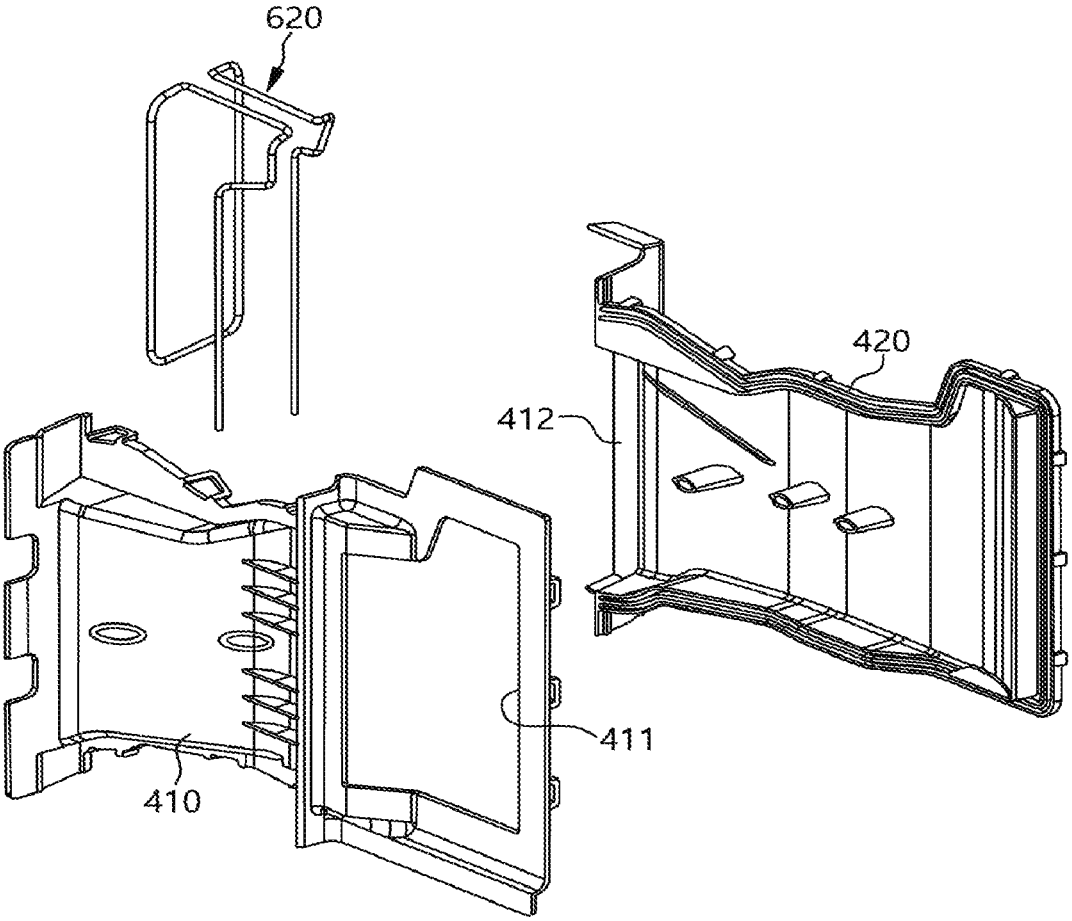
FIG. 12 is an exploded perspective view illustrating a state in which the supply duct of the refrigerator is viewed from the front according to the exemplary embodiment of the present disclosure.
Figure 13:
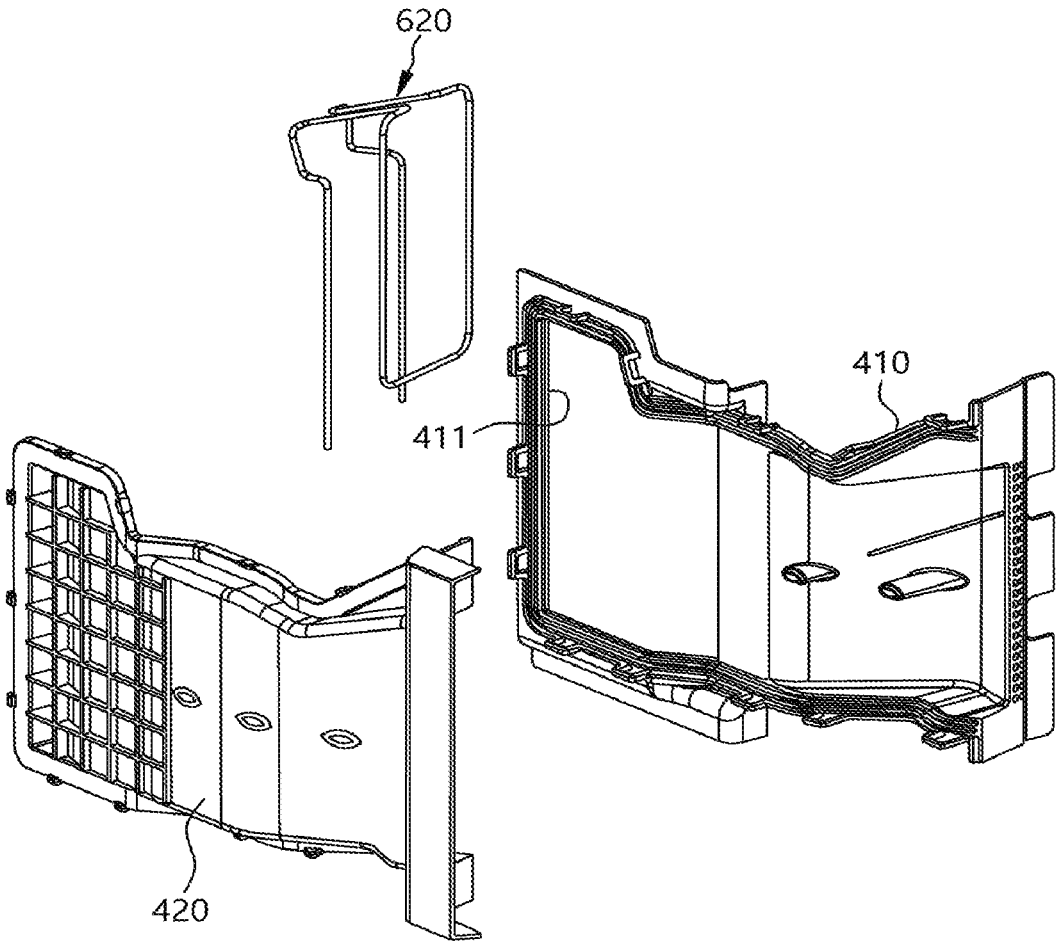
FIG. 13 is an exploded perspective view illustrating a state in which the supply duct of the refrigerator is viewed from the rear according to the exemplary embodiment of the present disclosure.
Figure 14:
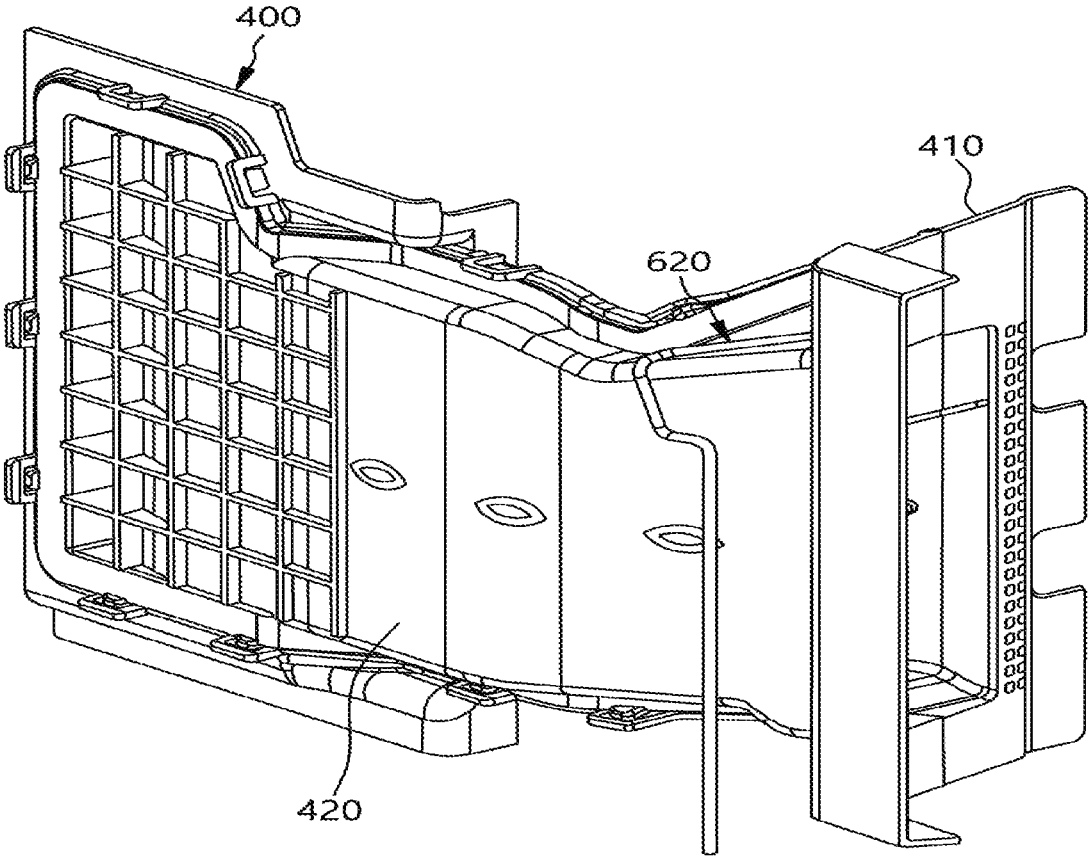
FIG. 14 is a combined perspective view illustrating a state in which the supply duct of the refrigerator is viewed from the rear according to the exemplary embodiment of the present disclosure.

As shown in the accompanying FIGS. 8 to 10, such a damper assembly 500 is configured to include a damper cover 510 and a damper 520.

The damper cover 510 is a part installed in a connection region between the supply duct 400 and the second grill assembly 300.

The damper cover 510 may be formed of a heat insulating material (e.g., Styrofoam).

In addition, the damper cover 510 is formed to have an inlet through which cold air is introduced and an outlet through which the cold air is discharged, and is provided with a passing flow path 501 formed therein to communicate the inlet and the outlet with each other. In this case, the inlet of the damper cover 510 communicates with the region where the blowing fan 340 of the second grill assembly 300 is positioned, and the outlet of the damper cover 510 communicated with the inlet 412 of the supply duct 400.

In addition, the damper 520 is installed in the passing flow path 501 of the damper cover 510. The damper 520 is formed to rotate by the operation of a damper motor 521 while being coupled to the damper motor 521, so as to open and close the passing flow path 501.

Next, the refrigerator according to the exemplary embodiment of the present disclosure may include heaters.

The heaters serve to provide heat to at least one region of the supply duct 400 or the damper assembly 500, thereby preventing the damper 520 from freezing.

Such heaters may include a first heater 610 for providing heat to the damper assembly 500.

The first heater 610 may be provided in the damper assembly 500.

For example, as shown in the accompanying FIGS. 8 and 10, the first heater 610 may be provided on an outer surface of the damper 520.

In particular, the first heater 610 may be positioned, among the outer surfaces of the damper 520, on a surface facing the supply duct 400 during the closing operation of the passing flow path 501. Accordingly, not only the damper 520 is prevented from freezing, but also the supply flow path 401 in the supply duct 400 may also be prevented from freezing due to the heat generated by the first heater 610.

For example, the first heater 610 may be formed of a surface heating element. Accordingly, the heater may be installed on the surface of the damper 520, and the entire region of the damper 520 may be uniformly heated.

In addition, the heaters may include a second heater 620 for providing heat to the supply duct 400.

As shown in the accompanying FIGS. 6 to 14, such a second heater 620 may be provided on an outer surface of the supply duct 400. For example, while being formed by a coil heater, the second heater 620 may be installed to be in contact along at least a region of the outer surface of the supply duct 400. That is, considering that maintenance of a heater may be difficult when the corresponding heater is provided on an inner surface of the supply duct 400, the heater is provided on the outer surface of the supply duct 400, so that the maintenance and installation may be made easy.

The second heater 620 may be installed at a position to be closer contact with a region among one end and the other end of the supply duct 400, the region connecting to the damper assembly 500. That is, considering that condensate water is generated in a place where there is a large temperature difference, from among the outer surfaces of the supply duct 400, the condensate water is more likely to be generated as the second heater 620 is positioned toward the region connecting to the damper assembly 500. In addition, the frosting is less likely to occur as the second heater 620 is positioned toward a region connecting to the first grill assembly 200 due to a temperature higher than a dew point temperature. Considering this, it is preferable to position the second heater 620 at the region connecting to the damper assembly 500 as much as possible.

The second heater 620 may be installed such that at least a part thereof is positioned at a corner formed at the region connecting to the damper assembly 500 among the outer surfaces of the supply duct 400.

That is, freezing of the condensate water generated in the corresponding region may be prevented by placing the second heater 620 in the region where the condensate water is most likely to be generated. In addition, since the corner is a bent region, the corner is most preferred as an installation position in that the second heater 620 made of a coil heater may be kept correctly installed even though accessory structures for the second heater 620 are not formed on the outer surface of the supply duct 400.

In addition, the second heater 620 may be installed such that at least a part thereof is positioned on a central region of the outer surface of the supply duct 400. That is, considering that condensate water may also be generated in the central region of the outer surface of the supply duct 400, a part of the second heater 620 is placed in the corresponding region in order to prevent the condensate water generated in the corresponding region from freezing.

In addition, another part of the second heater 620 may be formed to be installed along an upper surface of the supply duct 400. That is, the second heater 620 is installed so as to be closer contact with the upper side region of the supply duct 400 than the lower side region of the supply duct 400, whereby the condensate water generated on the upper surface of the supply duct 400 may be prevented from freezing. In this case, the second heater 620 is formed such that a region thereof from the corner of one end of the supply duct 400 to the central side of the supply duct 400 is installed along the upper surface of the supply duct 400.

In addition, the first heater 610 may be provided to have a higher output value than that of the second heater 620. That is, the second heater 620 is configured to perform a function of assisting the first heater 610 so as to reduce consumption of power as much as possible.

Naturally, in the refrigerator according to the exemplary embodiment of the present disclosure, only the first heater 610 or only the second heater 620 may be provided.

However, when only the first heater 610 is provided, since heat should be generated with a sufficiently high output in order to prevent freezing inside the supply duct 400, power consumption is severe and there may be a risk of affecting the temperature of the second storage compartment 131.

In addition, since the second heater 620 is provided on the outer surface of the supply duct 400, it is difficult to effectively prevent freezing of the damper 520 when only the second heater 620 is provided. Moreover, in order to prevent the damper 520 from freezing, heat should be generated at a high output. In this case, since the central side region of the supply duct 400 is unnecessarily provided with excessive heat, the power consumption is inevitably increased.

In consideration of this, providing the first heater 610 and the second heater 620 together is most advantageous in preventing the freezing or reducing the power consumption.

Next, the refrigerator according to the exemplary embodiment of the present disclosure may include a sensing part 700.

A sensing part 700 may be provided for sensing a temperature for each region or sensing humidity. To this end, the sensing part 700 may include at least one or more sensors.

Figure 15:
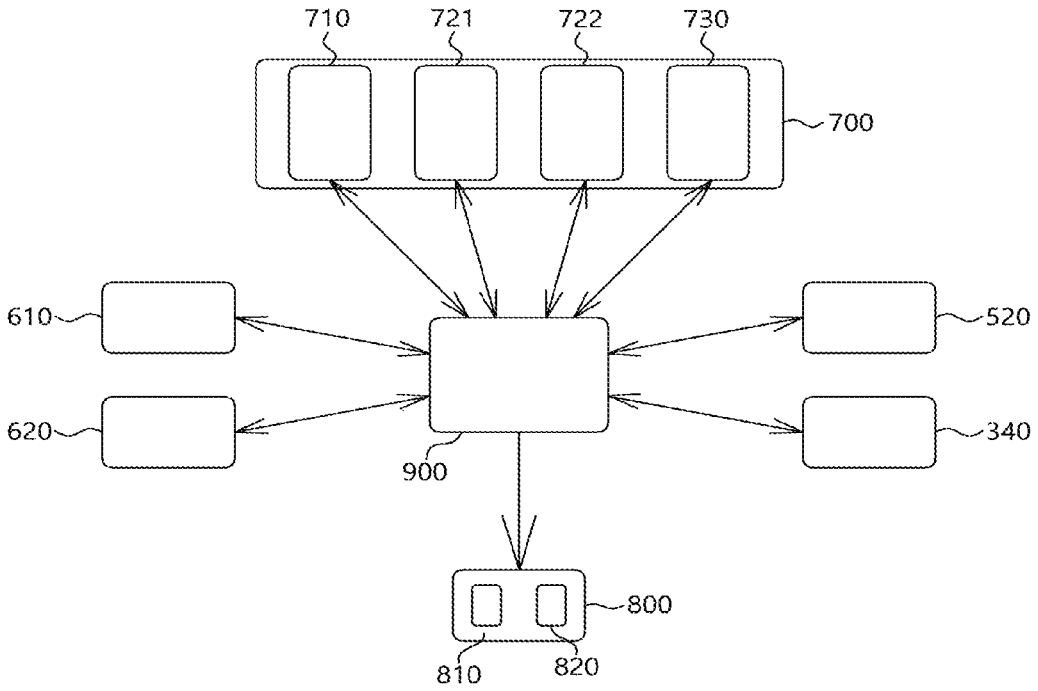
FIG. 15 is a block diagram schematically illustrating a controller of the refrigerator according to the exemplary embodiment of the present disclosure.
Figure 16:
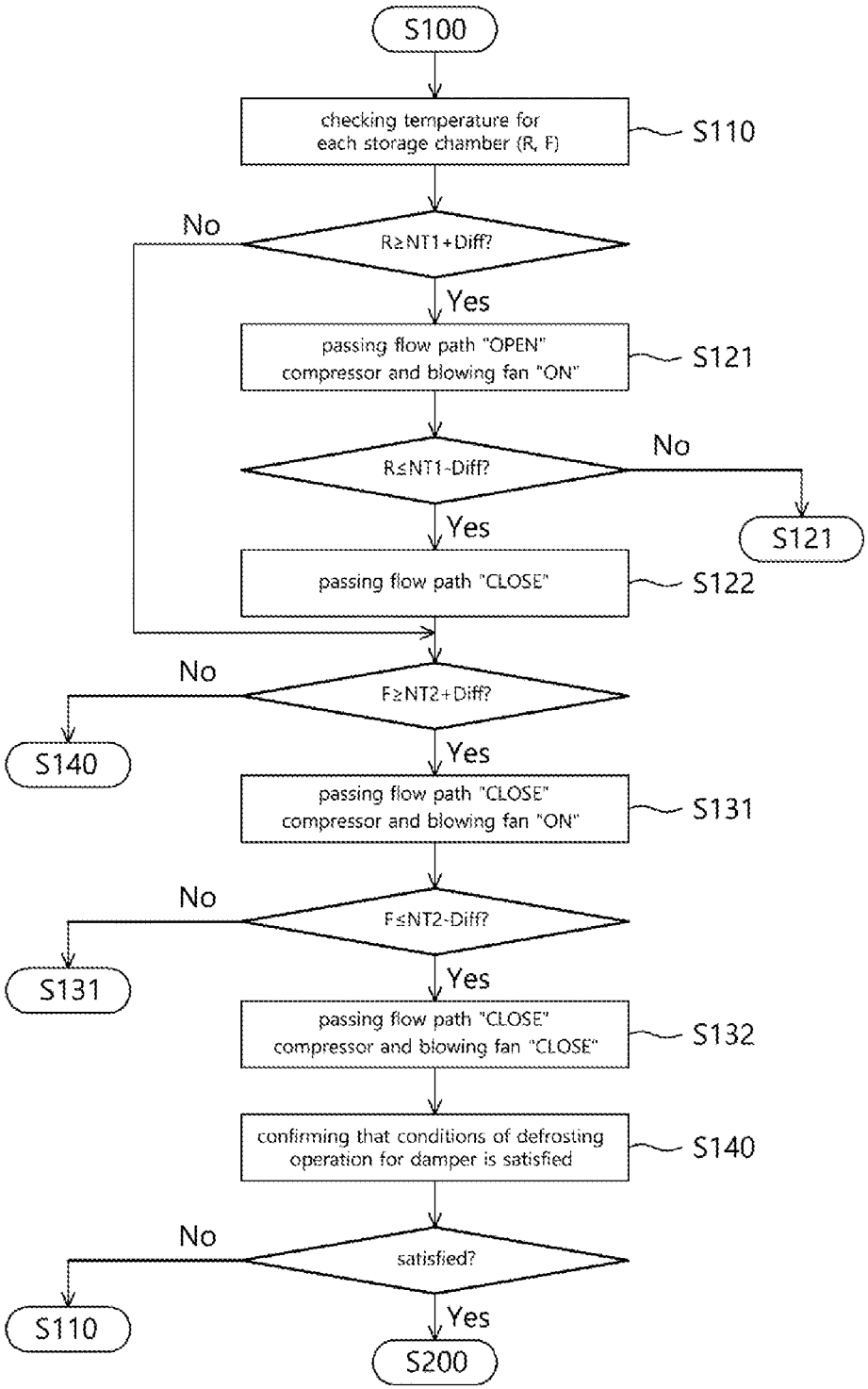
FIG. 16 is a flowchart illustrating a control process during a cooling operation of the refrigerator according to the exemplary embodiment of the present disclosure.

The sensing part 700 may include a room temperature sensor 710 (See the accompanying FIG. 15).

The room temperature sensor 710 is a sensor provided to detect a room temperature RT.

Such a room temperature sensor 710 may be installed in at least any one region of the refrigerator body 110 or doors 122 and 132. For example, although not shown, the room temperature sensor 710 may be configured to detect a room temperature while being installed on the front surface of each of the doors 122 and 132.

In addition, the sensing part 700 may include refrigerator internal temperature sensors 721 and 722.

The refrigerator internal temperature sensors 721 and 722 are sensors provided to detect respective temperatures in the storage compartments 121 and 131. Such refrigerator internal temperature sensors 720 may be respectively provided in the storage compartment 121 and 131. For example, the refrigerator internal temperature sensors 720 may include: a first refrigerator internal temperature sensor 721 provided in the first grill assembly 200 and configured to sense a temperature in the first storage compartment 121; and a second refrigerator internal temperature sensor 722 provided in the second grill assembly 300 and configured to sense a temperature in the second storage compartment 131. In this regard, views are provided as shown in the accompanying FIGS. 3 and 4.

In addition, the sensing part 700 may include a refrigerator internal humidity sensor 730.

The refrigerator internal humidity sensor 730 is a sensor provided to detect humidity in the storage compartment. Such a refrigerator internal humidity sensor 730 may be provided in one of the two storage compartments 121 and 131, and may be configured to sense the humidity in the corresponding storage compartment.

For example, the refrigerator internal humidity sensor 730 may be configured to sense the refrigerator internal humidity of the first storage compartment 121 maintained in a relatively high temperature range among the two storage compartments 121 and 131. Naturally, the refrigerator internal humidity sensor 730 may be provided in the second storage compartment 131 as well, but since the second storage compartment 131 is maintained at an extremely low temperature, the humidity is low. Considering this, since the refrigerator internal humidity sensed in the second storage compartment 131 does not affect the freezing of the damper 520, it is unnecessary to provide the refrigerator internal humidity sensor 730 in the second storage compartment 131.

As shown in the accompanying FIGS. 3 and 4, the refrigerator internal humidity sensor 730 may be installed in the first grill assembly 200. For example, as a communication hole 212 is formed in the first grill pan 210 and the refrigerator internal humidity sensor 730 is installed between the first grill pan 210 and the first duct plate 220, the refrigerator internal humidity sensor 730 may be positioned so as to be exposed to the interior of the first storage compartment 121 through the communication hole 212.

The refrigerator internal humidity sensor 730 may be provided at a higher position than that of the center among each region in the first storage compartment 121. That is, in the interior of the first storage compartment 121, since humidity in a space at a lower side relative to the center is low due to a natural convection phenomenon, discrimination power for determining humidity is low. In consideration of this, it is preferable to provide the refrigerator internal humidity sensor 730 at the higher position than the center among each region of the first storage compartment 121 in that a significant humidity value sufficient to have the discrimination power may be obtained.

The refrigerator internal humidity sensor 730 may be provided at a lower position than that of the supply duct 400 among each region in the first storage compartment 121. That is, the supply duct 400 is provided in an upper space of each storage compartment 121 and 131 in consideration of cold air circulation. However, humidity at the same height as that of the supply duct 400 or humidity at the higher height than that of the upper side space is excessively high, thereby having low discrimination power.

Accordingly, it is most preferable to provide the refrigerator internal humidity sensor 730 at the higher position than the position of the center among each region in the first storage compartment 121 and lower than the position of the supply duct 400 in that a significant humidity range to an extent discrimination power is secured may be obtained.

For example, the refrigerator internal humidity sensor 730 may be installed to be positioned below a shelf 123 positioned at the uppermost side among each of the shelves provided in the first storage compartment 121. Accordingly, the refrigerator internal humidity sensor 730 is less affected by the humidity existing in the uppermost side space in the first storage compartment 121 by means of the shelf 123, thereby obtaining humidity values showing changes capable of having sufficient discrimination power.

Next, the refrigerator according to the exemplary embodiment of the present disclosure may include a controller 900.

Such a controller 900 may be configured to control the operation of the entire refrigerator.

For example, a cooling operation may be performed such that cold air is selectively generated while the operation of a refrigeration system 800 including the compressor 820 and the evaporator 810 is controlled by the controller 900, and the cold air is selectively supplied to each of the storage compartments 121 and 131 while the operation of the blowing fan 340 and the damper assembly 500 is controlled.

In addition, while heat generation of the heaters 610 and 620 is controlled by the controller 900, the defrosting operation for the damper to prevent freezing of the damper 520 constituting the damper assembly 500 may be performed.

In particular, the controller 900 may be configured to control at least any one operation of the compressor 820, the damper 520, and the heaters 610 and 620 while having at least one or more operating conditions, so as to perform the cooling operation or defrosting operation for the damper.

Such operating conditions of the controller 900 for the defrosting operation for the damper may include at least any one operating condition set on the basis of a sensing value of at least any one sensor among the room temperature sensor 710 and the refrigerator internal humidity sensor 730.

A first operating condition that is set in the controller 900 may have at least one of conditions, including: a condition in which a room temperature falls within a first set temperature range; a condition in which the room temperature falls within a temperature range higher than the first set temperature range; a condition in which humidity in the first storage compartment 121 falls within a first set humidity range; and a condition in which the humidity in the first storage compartment 121 falls within a humidity range higher than the first set humidity range.

In addition, the operating condition of the controller 900 may include at least any one operating condition set on the basis of whether at least any one of the damper 520 and the compressor 820 operates or not.

The operating condition set in the controller 900 may include at least one of conditions, including: a condition in which the damper 520 is operated to block a flow of cold air guided to the supply duct 400; a condition in which the damper 520 is operated to open the flow of the cold air guided to the supply duct 40; a condition in which the compressor 820 is operated; and a condition in which the compressor 820 is stopped.

Preferably, the operating condition set in the controller 900 may include a first condition in which when a room temperature is maintained in the first set temperature range and a flow of cold air guided to the supply duct 400 is blocked, the heaters 610 and 620 are controlled to generate heat.

In addition, the operating condition set in the controller 900 may include a second condition in which when a room temperature is maintained in the first set temperature range and the compressor 820 is stopped, the heaters 610 and 620 are controlled to generate heat.

In addition, the operating condition set in the controller 900 may include a third condition in which when humidity in the first storage compartment 121 confirmed by the refrigerator internal humidity sensor 730 belongs to higher humidity than the first set humidity range and the flow of cold air guided to the supply duct 400 is blocked, the heaters 610 and 620 are controlled to generate heat.

In addition, the operating condition set in the controller 900 may include a fourth condition in which when the humidity in the first storage compartment 121 confirmed by the refrigerator internal humidity sensor 730 belongs to the higher humidity than the first set humidity range and the compressor 820 is stopped, the heaters 610 and 620 are controlled to generate heat.

In addition, the operating condition set in the controller 900 may include a fifth condition in which when the humidity in the first storage compartment 121 confirmed by the refrigerator internal humidity sensor 730 falls within the first set humidity range, the heaters 610 and 620 are controlled to stop generating heat regardless of a room temperature.

In addition, the operating condition set in the controller 900 may include a sixth condition in which when a room temperature is higher than the first set temperature range, the heaters 610 and 620 are controlled to stop generating heat.

Hereinafter, the operation control process of the refrigerator according to the exemplary embodiment of the present disclosure described above and the operation of each component due to such a control will be described in more detail with reference to the flowcharts and tables of the accompanying FIGS. 10 to 14.

First, the operation of the refrigerator according to the exemplary embodiment of the present disclosure may include step S100 of a cooling operation.

Such step S100 of the cooling operation is an operation performed to maintain a temperature within a set temperature range while selectively supplying cold air to each of storage compartments 121 and 131.

In step S100 of the cooling operation (i.e., the operation for supplying cold air), when a performance condition is satisfied (i.e., when a refrigerator internal temperature of at least any one storage compartment belongs to unsatisfactory temperatures), the refrigeration system 800 including the compressor 820 is operated, and also the blowing fan 340 is operated.

In addition, when step S100 of the cooling operation is performed, a controller 900 for controlling the operation of the refrigerator controls the operation of a damper 520 according to a temperature in each of the storage compartments 121 and 131.

For example, in step S110, the controller 900 checks the temperature for each of the storage compartments (R, F) 121 and 131 through each of refrigerator internal temperature sensors 721 and 722.

In addition, through such temperature confirmation in step S110, when the refrigerator internal temperature of the first storage compartment 121 belongs to the unsatisfactory temperatures that is a temperature higher than an upper limit reference temperature (NT1+Diff) specified on the basis of a set reference temperature NT1, cold air is controlled to be supplied to the first storage compartment 121 in step S121.

In this way, when the cold air is to be supplied to the first storage compartment 121, the controller controls the damper 520 to be opened so that a passing flow path 501 and a supply flow path 401 communicate with each other. Accordingly, the cold air passing through the evaporator 810 by the operation of the blowing fan 340 is introduced between the second duct plate 320 and the shroud 330 of the second grill assembly 300. Subsequently, a portion of the cold air is supplied into the second storage compartment through each second cold air outlet 311 formed in the second grill assembly 300, and the other portion of the cold air is supplied into the first storage compartment 121 by sequentially passing through the passing flow path 501 of the damper assembly 500, and the supply flow path 401 of the supply duct 400.

In this case, while the cold air sequentially passes through the passing flow path 501 and the supply flow path 401, power supply to the first heater 610 and the second heater 620 is controlled to be blocked. Accordingly, an unwanted increase in the temperature of the cold air supplied to the first storage compartment 121 may be prevented.

In addition, when the refrigerator internal temperature in the first storage compartment 121 reaches a lower limit temperature NT1−Diff set on the basis of the set reference temperature NT1, the supply of cold air to the first storage compartment 121 is stopped. That is, in step S122, the operation of the damper 520 is controlled to block the passing flow path 501.

When the refrigerator internal temperature of the first storage compartment 121 is a satisfactory temperature, whereas the refrigerator internal temperature of the second storage compartment 131 belongs to unsatisfactory temperatures (i.e., temperatures exceeding NT2+Diff), the cold air is controlled to be supplied only to the second storage compartment 131 in step S131.

In this way, when cold air is to be supplied to the second storage compartment 131, the damper 520 is controlled to block the passing flow path 501. Accordingly, the cold air that has passed through the evaporator 810 by the operation of the blowing fan 340 is introduced between the second duct plate 320 and the shroud 330 of the second grill assembly 300, and then is supplied to the second storage compartment 131 through each of the second cold air outlets 311 of the second grill pan 310.

In addition, when the refrigerator internal temperature of the first storage compartment 121 is at a satisfactory temperature, and the refrigerator internal temperature of the second storage compartment 131 also reaches the lower limit temperature NT2−Diff among the satisfactory temperatures NT2±Diff, the supply of cold air to the second storage compartment 131 is also stopped in step S132. That is, the operation of the compressor 820 and the blowing fan 340 is stopped. Naturally, even though the operation of the compressor 820 is stopped, the blowing fan 340 may be controlled to operate, and the compressor 820 may be controlled to continue operating, but only the operation of the blowing fan 340 may be controlled to be stopped.

In addition, while step S100 of the cooling operation is performed, it is checked whether an operating condition of the defrosting operation for the damper is satisfied in step S140, so that when the operating condition is satisfied, step S200 of the defrosting operation for the damper is controlled to be performed.

Next, the operation of the refrigerator according to the exemplary embodiment of the present disclosure may include step S200 of a defrosting operation for the damper.

Step S200 of the defrosting operation for the damper may be performed in a state in which the damper 520 is operated to block the passing flow path 501.

That is, in the state in which the damper 520 blocks the passing flow path 501, the passing flow path 501 is affected by the temperature of the second storage compartment 131, whereas the supply flow path 401 in the supply duct 400 is affected by the temperature of the first storage compartment 121. In this case, considering that the second storage compartment 131 is maintained at a lower temperature than that of the first storage compartment 121, dew (i.e., condensate water) is formed in the surfaces of the damper 520, a damper cover 510, or the inside of the supply duct 400 due to temperature differences therebetween.

Naturally, dew is naturally removed from the inside of the passing flow path 501 of the damper assembly 500 due to dry cold air. However, the dew inside the supply duct 400 is continuously generated due to humid air in the second storage compartment 131, and in this process, the dew is frozen by the cooling heat conducted from the damper assembly 500.

In consideration of this, step S200 of the defrosting operation for the damper is performed, wherein when the damper 520 blocks the passing flow path 501 as described above, heat is provided to the damper 520 or the supply duct 400 by operation control that periodically causes at least any one of the first heater 610 and the second heater 620 to generate heat. That is, by performing step S200 of the defrosting operation for the damper, freezing of the damper 520 may be prevented, or the frozen damper 520 may be defrosted.

Such step S200 of the defrosting operation for the damper may be performed or terminated when at least any one condition is satisfied, the condition being set on the basis of at least any one piece of operation information including sensing information on sensing values provided from the sensing part 700 and operation information of the compressor, the blowing fan 340, or the damper 520.

In this case, the sensing information provided from the sensing part 700 may include information on sensing values of at least any one of the room temperature sensor 710, each of the refrigerator internal temperature sensors 721 and 722, and the refrigerator internal humidity sensor 730.

In addition, the conditions under which step 200 of the defrosting operation for the damper is performed may include at least one of the first to fourth conditions, which are operating conditions set in the controller 900.

This will be described in more detail for each example for each condition.

As an example, while step S100 of the general cooling operation is performed, the controller 900 checks whether a room temperature RT and an operation of the damper 520 satisfy the first condition.

Figure 17:
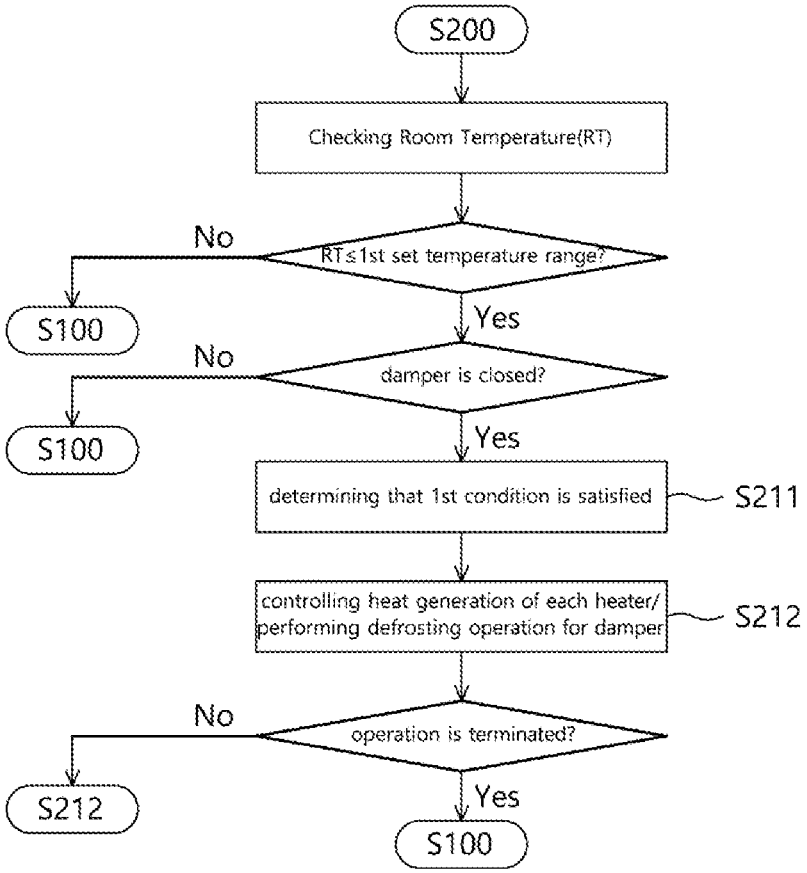
FIG. 17 is a flowchart illustrating a control process according to a first condition during a defrosting operation for a damper of the refrigerator according to the exemplary embodiment of the present disclosure.

For example, as shown in the accompanying FIG. 17, when a room temperature is maintained in the first set temperature range and the damper 520 is operated (i.e., the damper is closed) to block the supply duct 400 (i.e., to block the supply of cold air), the first condition is determined to be satisfied in step S211. In this case, the room temperature may be confirmed by the room temperature sensor 710.

In addition, when the first condition is determined to be satisfied, the controller 900 controls each of the heaters 610 and 620 to generate heat in step S212, thereby performing step S200 of the defrosting operation for the damper.

The first set temperature range may be a temperature lower than an average room temperature. For example, the first set temperature range may be set to a temperature less than or equal to 12.5° C. (R≤12.5° C.) as room temperatures in winter.

Meanwhile, as for the set temperature range, a plurality of set temperature ranges may be additionally set in addition to the first set temperature range.

For example, as shown in the table of the accompanying FIG. 18, the set temperature ranges may include: a second set temperature range higher than the first set temperature range; a third set temperature range higher than the second set temperature range; and a fourth set temperature range higher than the third set temperature range. For example, the second set temperature range may be set to 13.5° C.<RT≤17° C. The third set temperature range may be set to 17° C.<RT≤28° C. The fourth set temperature range may be set to 28° C.<RT. In this case, as for letter shown in the views, R is the first storage compartment 121, F is the second storage compartment 131, and Comp. is the compressor 820.

The lower limit temperature and upper limit temperature of each of the set temperature ranges may be absolute values as described above, and the lower limit temperature and upper limit temperature of each of the set temperature ranges may be set to temperature values considering a hysteresis section as shown in FIG. 19.

As another example, while step S100 of the general cooling operation is performed, the controller 900 checks whether a room temperature and an operation of the compressor 820 satisfy the second condition.

Figure 20:
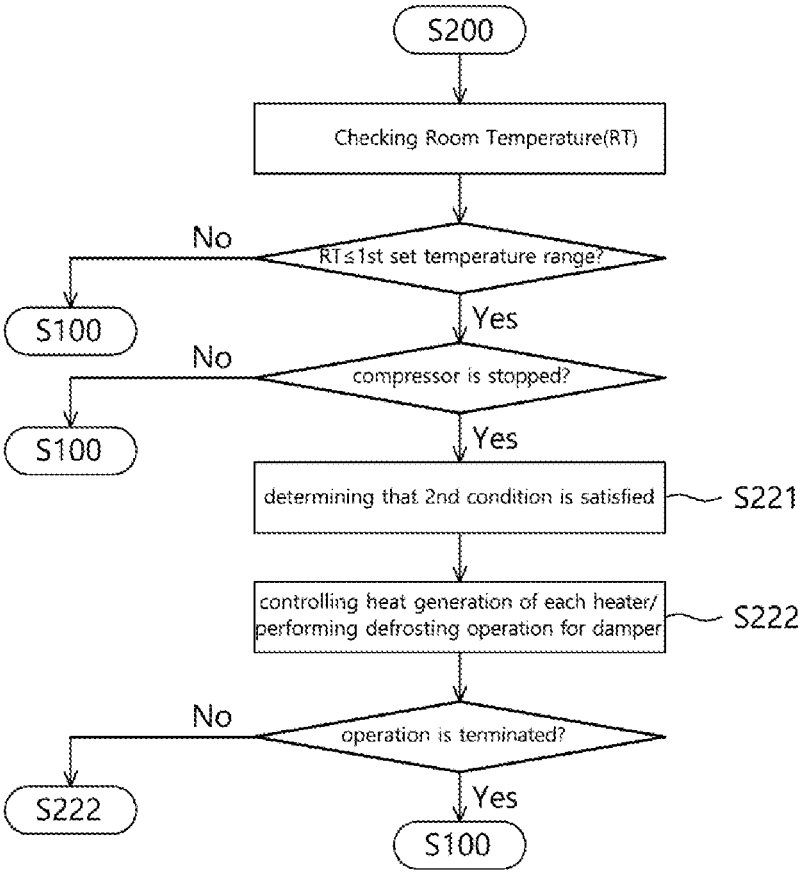
FIG. 20 is a flowchart illustrating a control process according to a second condition during the defrosting operation for the damper of the refrigerator according to the exemplary embodiment of the present disclosure.

For example, as shown in the accompanying FIG. 20, when a room temperature is maintained in the first set temperature range and the compressor 820 is in a stopped state thereof, the second condition is determined to be satisfied in step S221.

In addition, when the second condition is determined to be satisfied, the controller 900 controls each of the heaters 610 and 620 to generate heat in step S222, thereby performing step S200 of the defrosting operation for the damper.

As yet another example, while step S100 of the general cooling operation is being performed, the controller 900 checks whether humidity of the first storage compartment 121 and an operation of the damper 520 satisfy the third condition.

Figure 21:
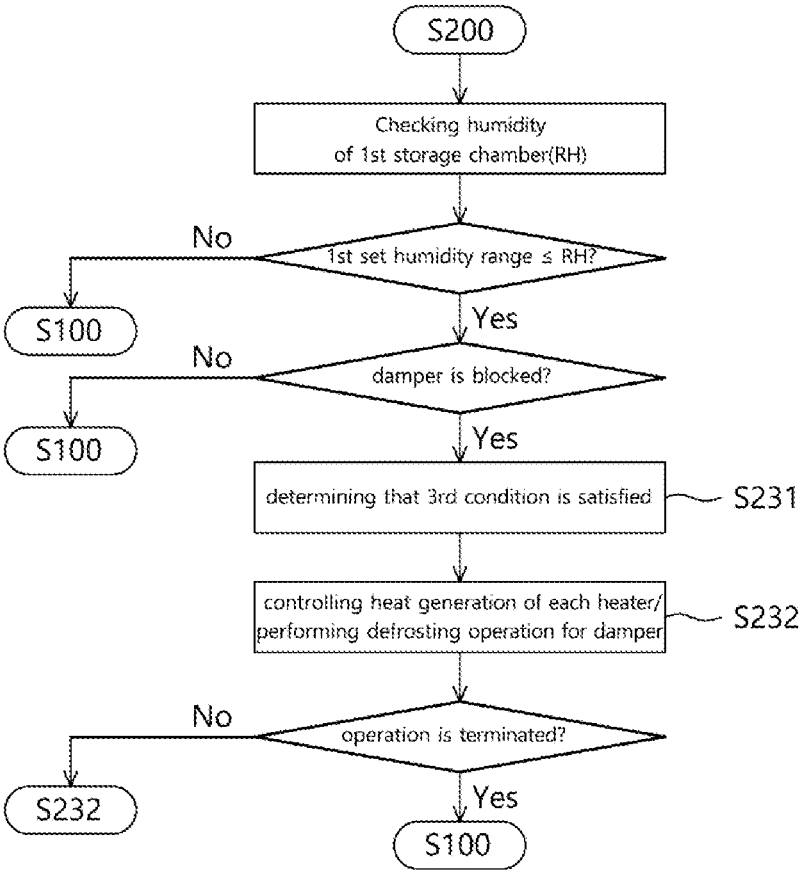
FIG. 21 is a flowchart illustrating a control process according to a third condition during the defrosting operation for the damper of the refrigerator according to the exemplary embodiment of the present disclosure.

For example, as shown in the accompanying FIG. 21, when humidity (RH: refrigerating compartment humidity) in the first storage compartment 121 belongs to higher humidity than a first set humidity range and the damper 520 is operated to block the supply duct 400 (i.e., to block the supply of cold air), the third condition is determined to be satisfied in step S231.

In addition, when the third condition is determined to be satisfied, the controller 900 controls each of the heaters 610 and 620 to generate heat in step S232, thereby performing step S200 of the defrosting operation for the damper.

Here, the first set humidity range may be a humidity range with a low risk of freezing despite a low temperature. For example, the first set humidity range may be humidity less than or equal to 35% (RH≤35%).

As for the set humidity range, at least one or more set humidity ranges may be additionally set in addition to the first set humidity range.

For example, the set humidity ranges may further include at least any one of humidity ranges including: a second set humidity range higher than the first set humidity range; a third set humidity range higher than the second set humidity range; and a fourth set humidity range higher than the third set humidity range. In this case, the second set humidity range may be set to 35%<RH≤40%. The third set humidity range may be set to 40%<RH≤50%. The fourth set humidity range may be set to 50%≤RH. In this regard, the humidity ranges are shown in the table of the accompanying FIG. 22.

As yet another example, while step S100 of the general cooling operation is performed, the controller 900 checks whether the humidity of the first storage compartment 121 and the operation of the compressor 820 satisfy the fourth condition.

Figures 22, 23:
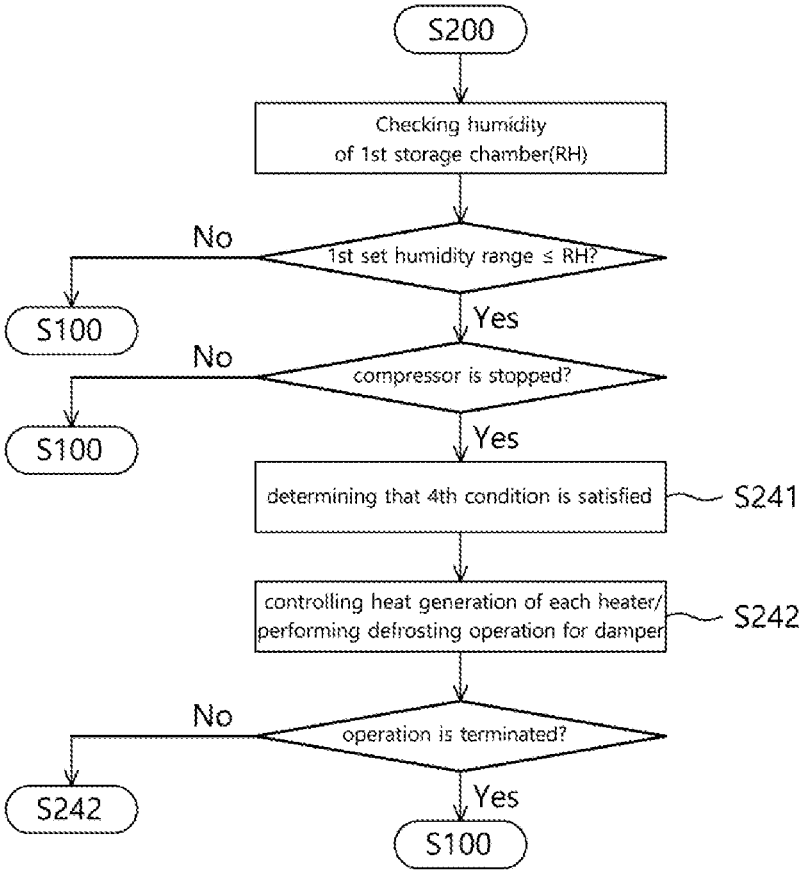
FIG. 22 is a state view illustrating operation states of the respective heaters on the basis of a refrigerator internal humidity condition for the defrosting operation for the damper of the refrigerator according to the exemplary embodiment of the present disclosure.
FIG. 23 is a flowchart illustrating a control process according to a fourth condition during the defrosting operation for the damper of the refrigerator according to the exemplary embodiment of the present disclosure.

For example, as shown in the accompanying FIG. 23, when the humidity in the first storage compartment 121 belongs to the higher humidity than the first set humidity range and the compressor 820 is stopped, the fourth condition is determined to be satisfied in step S241.

In addition, when the fourth condition is determined to be satisfied, the controller 900 controls each of the heaters 610 and 620 to generate heat in step S242, thereby performing step S200 of the defrosting operation for the damper. This is as shown in the accompanying FIG. 21.

Meanwhile, in the third or fourth condition, a humidity condition used as a criterion for determination may be set to room humidity instead of the humidity in the first storage compartment 121.

However, in a case where step S200 of the defrosting operation for the damper is controlled to be performed on the basis of room humidity, there is a problem in that the freezing of the damper 520 may not be properly managed when a user does not open the doors 122 and 132 for a long period of time, or when the humidity inside the first storage compartment 121 is excessive high. Considering this, it is preferable to determine the third condition or the fourth condition on the basis of the humidity in the first storage compartment 121 than to determine the third condition or the fourth condition on the basis of the room humidity in that heat may be provided to the supply duct 400 at a more accurate time. In addition, since heat generation control of the heaters 610 and 620 is performed only when actually necessary, power consumption due to unnecessary heat generated by the heaters may be reduced.

As such, the controller 900 selectively performs step S200 of the defrosting operation for the damper according to whether any one of each condition described above is satisfied.

In addition, when the heaters 610 and 620 are controlled to generate heat in step S200 of the defrosting operation for the damper, each of the heaters 610 and 620 may be controlled to generate heat at the same time, or only any one of the heaters 610 and 620 may be controlled to generate heat as well. Alternatively, each of the heaters 610 and 620 may be controlled to generate heat sequentially. However, in order to sufficiently defrost the entire region inside the supply duct 400, it is preferable that the two heaters 610 and 620 are controlled to generate heat at the same time.

In addition, each of the heaters 610 and 620 may be controlled to continue to generate heat for a predetermined time, or may be controlled to repeat generating heat for a predetermined time and stopping the heating for a predetermined time.

For example, as the room temperature is lower, the respective heaters 610 and 620 may be differentially controlled to generate heat for a longer period of time.

In addition, as the humidity inside the first storage compartment 121 is higher, the respective heaters 610 and 620 may be differentially controlled to generate heat for a longer period of time. For example, in the third set humidity range, each of the heaters 610 and 620 may be controlled to generate heat for a longer time than that of the second set humidity range. In the fourth set humidity range, each of the heaters 610 and 620 may be controlled to generate heat for a longer time than that of the third set humidity range.

In addition, each of the heaters 610 and 620 whose heat generation is controlled for different times according to the humidity range in the first storage compartment 121 may be controlled to be repeatedly operated after a predetermined time elapses when the heat generation is terminated. In this case, the time for which the heat generation is stopped may be set longer as the humidity in the first storage compartment 121 is lower. For example, in the third set humidity range, the heat generation of each of the heaters 610 and 620 may be controlled to be stopped for a shorter time than that of the second set humidity range. In the fourth set humidity range, the heat generation of each of the heaters 610 and 620 may be controlled to be stopped for a shorter time than that of the third set humidity range. Power consumption is minimized by controlling the heat generation of the different heaters 610 and 620 for each of such humidity ranges.

Accordingly, due to the (simultaneous or selective) heat generation of the first heater 610 and the second heater 620 described above, heat is provided to the damper assembly 500, the supply duct 400, and the connection regions between the damper assembly 500 and the supply duct 400, whereby freezing of the corresponding regions may be prevented.

Meanwhile, while step S100 of the cooling operation or step S200 of the defrosting operation for the damper is being performed, the controller 900 controls the respective heaters 610 and 620 to stop generating heat when the fifth or sixth condition in which the refrigerator internal humidity RH or room temperature RT of the first storage compartment 121 is set is satisfied, thereby stopping step S200 of the defrosting operation for the damper.

As an example, when the humidity in the first storage compartment 121 falls within the first set humidity range, the fifth condition is determined to be satisfied.

In addition, when the fifth condition is determined to be satisfied, the controller 900 controls each of the heaters 610 and 620 to stop generating heat, whereby step S200 of the defrosting operation for the damper is stopped.

When at least any one of the first condition or the second condition is satisfied even though the fifth condition is satisfied, the controller 900 obeys the condition under which the heaters 610 and 620 generate heat. That is, even though the fifth condition is satisfied, when either one of the first condition or the second condition is satisfied, step S200 of the defrosting operation for the damper is controlled to be performed.

As another example, when a room temperature is higher than the first set temperature range, the sixth condition is determined to be satisfied.

In addition, when the sixth condition is determined to be satisfied, the controller 900 controls each of the heaters 610 and 620 to stop generating heat, whereby step S200 of the defrosting operation for the damper is stopped.

When at least any one of the third condition or the fourth condition is satisfied even though the sixth condition is satisfied, the controller 900 obeys the condition under which the heaters 610 and 620 generate heat. That is, even though the sixth condition is satisfied, when either one of the third condition or the fourth condition is satisfied, step S200 of the defrosting operation for the damper is controlled to be performed.

As a result, in the refrigerator and the method of controlling the operation thereof according to the present disclosure, since each heater that provides heat to the damper assembly 500 and the supply duct 400 is provided, freezing of the damper assembly 500 or the connection region between the damper assembly 500 and the supply duct 400 may be prevented.

In addition, in the refrigerator and the method of controlling the operation thereof according to the present disclosure, since the refrigerator internal humidity sensor 730 is provided in the first storage compartment 121 to detect humidity in the first storage compartment 121, precise driving settings of step 200 of the defrosting operation for the damper may be performed on the basis of the humidity in the first storage compartment.

In addition, in the refrigerator and the method of controlling the operation thereof according to the present disclosure, since the refrigerator internal humidity sensor 730 is provided at the higher position than that of the center in the first storage compartment, the humidity in the first storage compartment may be checked as much as possible.

In addition, in the refrigerator and the method of controlling the operation thereof according to the present disclosure, since the refrigerator internal humidity sensor 730 is provided at the lower position than the supply duct 400, more significant discrimination may be obtained than the case of measuring excessively high humidity at the higher position than the supply duct 400.

In addition, in the refrigerator and the method of controlling the operation thereof according to the present disclosure, since the refrigerator internal humidity sensor 730 is provided at the position below the shelf 123 positioned at the uppermost side among the shelves 123 provided in the first storage compartment 121, more significant discrimination may be obtained than the case of measuring excessively high humidity of the space at the uppermost side in the first storage compartment 121.

In addition, in the refrigerator and the method of controlling the operation thereof according to the present disclosure, since step S200 of the defrosting operation for the damper is controlled in consideration of the humidity in the first storage compartment 121 and the room temperature at the same time, unnecessary power consumption due to heat generated by the heaters 610 and 620 may be reduced.

The present disclosure has been devised to solve various problems according to the related art described above, and an objective of the present disclosure is to prevent freezing of a supply duct configured to guide a flow of cold air from one storage compartment to another storage compartment and freezing of a damper configured to open and close the corresponding supply duct.

In addition, another objective of the present disclosure is to allow heaters provided for preventing freezing of a damper to be operated only when there is a risk of the freezing during use of a refrigerator, so as to reduce consumption of power, thereby improving power consumption.

In addition, yet another objective of the present disclosure is to minimize influence on a refrigerator internal temperature due to excessive heat generation of heaters provided for preventing a damper from freezing.

According to a refrigerator of the present disclosure for achieving the above objectives, the refrigerator may include a damper configured to selectively block a flow of cold air guided to a supply duct.

In addition, according to the refrigerator of the present disclosure, the refrigerator may include heaters configured to provide heat to at least any one of the damper or the supply duct.

In addition, according to the refrigerator of the present disclosure, the refrigerator may include a room temperature sensor configured to detect a room temperature.

In addition, according to the refrigerator of the present disclosure, the refrigerator may include a refrigerator internal humidity sensor configured to detect humidity in any one of the two storage compartments.

In addition, according to the refrigerator of the present disclosure, the refrigerator may include a controller configured to control at least any one operation of the compressor, the damper, and each heater.

In addition, according to the refrigerator of the present disclosure, the controller may include at least any one operating condition set on the basis of a sensing value of at least any one of the room temperature sensor and the refrigerator internal humidity sensor.

In addition, according to the refrigerator of the present disclosure, the conditions set in the controller may include a condition in which the room temperature checked by the room temperature sensor falls within a first set temperature range.

In addition, according to the refrigerator of the present disclosure, the conditions set in the controller may include a condition in which the room temperature confirmed by the room temperature sensor falls within a temperature range higher than the first set temperature range.

In addition, according to the refrigerator of the present disclosure, the conditions set in the controller may include a condition in which the damper is operated to block a flow of the cold air guided to the supply duct.

In addition, according to the refrigerator of the present disclosure, the conditions set in the controller may include a condition in which the damper is operated to open the flow of the cold air guided to the supply duct.

In addition, according to the refrigerator of the present disclosure, the conditions set in the controller may include a condition in which the humidity in the storage compartment confirmed by the refrigerator internal humidity sensor falls within a first set humidity range.

In addition, according to the refrigerator of the present disclosure, the conditions set in the controller may include a condition in which the humidity in the storage compartment confirmed by the refrigerator internal humidity sensor falls within a humidity range higher than the first set humidity range.

In addition, according to the refrigerator of the present disclosure, the conditions set in the controller may include room temperature conditions and damper operating conditions at the same time.

In addition, according to the refrigerator of the present disclosure, the conditions set in the controller may include the room temperature conditions and room humidity conditions at the same time.

In addition, according to the refrigerator of the present disclosure, the conditions set in the controller may include the damper operating conditions and the room humidity conditions at the same time.

In addition, according to the refrigerator of the present disclosure, operating conditions set in the controller may include a first condition for controlling the heaters to generate the heat when the room temperature is maintained in the first set temperature range and the flow of the cold air guided to the supply duct is blocked.

In addition, according to the refrigerator of the present disclosure, operating conditions set in the controller may include a second condition for controlling the heaters to generate the heat when the room temperature is maintained in a first set temperature range and the compressor is stopped.

In addition, according to the refrigerator of the present disclosure, operating conditions set in the controller may include a third condition for controlling the heaters to generate the heat when the humidity in the storage compartment confirmed by the refrigerator internal humidity sensor belongs to higher humidity than a first set humidity range and the flow of the cold air guided to the supply duct is blocked.

In addition, according to the refrigerator of the present disclosure, operating conditions set in the controller may include a fourth condition for controlling the heaters to generate the heat when the humidity in the storage compartment confirmed by the refrigerator internal humidity sensor belongs to the higher humidity than a first set humidity range and the compressor is blocked.

In addition, according to the refrigerator of the present disclosure, operating conditions set in the controller may include a fifth condition for controlling the heaters to stop generating the heat regardless of the room temperature when the humidity in any one storage compartment confirmed by the refrigerator internal humidity sensor falls within a first set humidity range.

In addition, according to the refrigerator of the present disclosure, any one storage compartment of the two storage compartments may be configured to maintain a lower temperature range than the other storage compartment.

In addition, according to the refrigerator of the present disclosure, when the damper is operated to block the flow of the cold air guided to the supply duct, the cold air may be supplied to the storage compartment having a relatively low temperature among the two storage compartments.

In addition, according to the refrigerator of the present disclosure, the heaters may include a first heater that provides the heat to the damper.

In addition, according to the refrigerator of the present disclosure, the heaters may include a second heater that provides the heat to the supply duct.

In addition, according to the refrigerator of the present disclosure, the controller may be configured to control at least any one of the first heater and the second heater to generate the heat when at least any one condition that is set is satisfied.

In addition, according to the refrigerator of the present disclosure, the refrigerator internal humidity sensor may be arranged to sense refrigerator internal humidity in the storage compartment maintained in a relatively high temperature range among the two storage compartments.

In addition, according to the refrigerator of the present disclosure, the refrigerator internal humidity sensor may be provided at a higher position than that of a center among each region of the storage compartment, and may be provided at a lower position than that of the supply duct.

In addition, according to the refrigerator of the present disclosure, the refrigerator internal humidity sensor may be positioned below a shelf positioned at an uppermost side.

According to a method of controlling an operation of the present disclosure for achieving the above objectives, the method may include performing a cooling operation to maintain each storage compartment in a set temperature range.

In addition, according to the method of controlling the operation of the present disclosure, the cooling operation may be performed while supplying or blocking cold air to at least any one of two storage compartments by controlling an operation of selectively opening a supply duct through an operation of a damper and by controlling an operation of a compressor.

In addition, according to the method of controlling the operation of the present disclosure, the method may include performing a defrosting operation for the damper to prevent freezing of the damper or to defrost the frozen damper.

In addition, according to the method of controlling the operation of the present disclosure, the defrosting operation for the damper may be performed by controlling operations of heaters configured to provide heat to the damper or the supply duct.

In addition, according to the method of controlling the operation of the present disclosure, the defrosting operation for the damper may be performed while controlling an operation of the heater when at least one operating condition is satisfied.

In addition, according to the method of controlling the operation of the present disclosure, operating conditions of the defrosting operation for the damper may be set on the basis of information on a sensing value of at least any one of a room temperature sensor, each of refrigerator internal temperature sensors, and a refrigerator internal humidity sensor, and at least any one piece of information of either operation information of the compressor or operation information of the damper.

In addition, according to the method of controlling the operation of the present disclosure, the operating conditions of the defrosting operation for the damper may include a condition in which a room temperature checked by the room temperature sensor falls within a first set temperature range.

In addition, according to the method of controlling the operation of the present disclosure, the operating conditions of the defrosting operation for the damper may include a condition in which the room temperature confirmed by the room temperature sensor falls within a temperature range higher than the first set temperature range.

In addition, according to the method of controlling the operation of the present disclosure, the operating conditions of the defrosting operation for the damper may include a condition in which the damper operates to block a flow of cold air guided to the supply duct.

In addition, according to the method of controlling the operation of the present disclosure, the operating conditions of the defrosting operation for the damper may include a condition in which the damper operates to open the flow of the cold air guided to the supply duct.

In addition, according to the method of controlling the operation of the present disclosure, the operating conditions of the defrosting operation for the damper may include a condition in which humidity in the storage compartment confirmed by the refrigerator internal humidity sensor falls within a first set humidity range.

In addition, according to the method of controlling the operation of the present disclosure, the operating conditions of the defrosting operation for the damper may include a condition in which the humidity in the storage compartment confirmed by the refrigerator internal humidity sensor falls within a higher humidity range than the first set humidity range.

In addition, according to the method of controlling the operation of the present disclosure, the operating conditions of the defrosting operation for the damper may include room temperature conditions and damper operating conditions at the same time.

In addition, according to the method of controlling the operation of the present disclosure, the operating conditions of the defrosting operation for the damper may include the room temperature conditions and room humidity conditions at the same time.

In addition, according to the method of controlling the operation of the present disclosure, the operating conditions of the defrosting operation for the damper may include the damper operating conditions and the room humidity conditions at the same time.

In addition, according to the method of controlling the operation of the present disclosure, in the operating conditions of the defrosting operation for the damper, when the room temperature is maintained in the first set temperature range and the damper is operated to block the supply duct (i.e., to block supply of the cold air), a first condition may be determined to be satisfied, so that the heaters may be controlled to generate the heat.

In addition, according to the method of controlling the operation of the present disclosure, in the operating conditions of the defrosting operation for the damper, when the room temperature is maintained within the first set temperature range and the compressor is stopped, a second condition may be determined to be satisfied, so that the heaters may be controlled to generate the heat.

In addition, according to the method of controlling the operation of the present disclosure, in the operating conditions of the defrosting operation for the damper, when the humidity in the storage compartment is higher than the first set humidity range and the damper is operated to block the supply duct (i.e., to block the supply of the cold air), a third condition may be determined to be satisfied, so that the heaters may be controlled to generate the heat.

In addition, according to the method of controlling the operation of the present disclosure, in the operating conditions of the defrosting operation for the damper, when the humidity in the storage compartment belongs to the higher humidity than the first set humidity range and the compressor is stopped, a fourth condition may be determined to be satisfied, so that the heaters may be controlled to generate the heat.

In addition, according to the method of controlling the operation of the present disclosure, in the operating conditions of the defrosting operation for the damper, when the humidity in the storage compartment falls within the first set humidity range, a fifth condition may be determined to be satisfied, so that the heaters may be controlled to stop generating the heat.

In addition, according to the method of controlling the operation of the present disclosure, the operating conditions of the defrosting operation for the damper may further include at least one or more set humidity ranges in which the humidity in any one storage compartment confirmed by the refrigerator internal humidity sensor is set to be higher than the first set humidity range.

In addition, according to the method of controlling the operation of the present disclosure, the operating conditions of the defrosting operation for the damper may control the heater to generate the heat for a longer period of time as the humidity in the storage compartment is higher.

In addition, according to the method of controlling the operation of the present disclosure, the operating conditions of the defrosting operation for the damper may control the heater to generate the heat for the longer period of time as the temperature in the storage compartment is lower.

As described above, the present disclosure has the following various effects.

First, in the refrigerator and the method of controlling the operation thereof according to the present disclosure, since heaters respectively providing heat to a damper assembly and a supply duct are provided, freezing of the damper assembly or freezing of a connection region between the damper assembly and the supply duct may be prevented.

In addition, in the refrigerator and the method of controlling the operation thereof according to the present disclosure, since a refrigerator internal humidity sensor is provided in a first storage compartment to detect humidity in the first storage compartment, precise operation settings of a defrosting operation for the damper may be conducted on the basis of the humidity in the first storage compartment.

In addition, in the refrigerator and the method of controlling the operation thereof according to the present disclosure, since the refrigerator internal humidity sensor is provided at a higher position than that of a center in the first storage compartment, the humidity in the first storage compartment may be checked as accurately as possible.

In addition, in the refrigerator and the method of controlling the operation thereof according to the present disclosure, since the refrigerator internal humidity sensor is provided at a lower position than the supply duct, more significant discrimination may be obtained than that of a case in which excessively high humidity at a higher position than the supply duct is measured.

In addition, in the refrigerator and the method of controlling the operation thereof according to the present disclosure, since the refrigerator internal humidity sensor is provided at a position below a shelf, positioned at an uppermost side, among each of shelves provided in the first storage compartment, more significant discrimination may be obtained than that of a case in which excessively high humidity of a space at the uppermost side in the first storage compartment is measured.

In addition, in the refrigerator and the method of controlling the operation thereof according to the present disclosure, since the defrosting operation for the damper is controlled in consideration of the humidity in the first storage compartment and the room temperature at the same time, unnecessary consumption of power due to heat generated by the heaters may be reduced.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a refrigerator body defining a first storage compartment and a second storage compartment having, respectively, different target temperature ranges;

a supply duct configured to guide at least a portion of cold air, which is generated by an operation of a compressor and is flowing to one of the first or second storage compartments, to another one of the first or second storage compartments;

a damper configured to selectively block a flow of the cold air guided to the supply duct;

one or more heaters configured to provide heat to at least one of the damper or the supply duct;

a room temperature sensor configured to detect a room temperature;

refrigerator internal temperature sensors configured to detect respective temperatures in the first and second storage compartments;

a refrigerator internal humidity sensor configured to detect humidity in at least one of the first or second storage compartments; and a controller configured to control operation of at least one of the heaters when at least one condition, that is evaluated on a basis of a sensing value of at least one of the room temperature sensor or the refrigerator internal humidity sensor, is satisfied, wherein one of the first or the second storage compartments includes a vertical surface having an outlet to receive cold air from the supply duct, and the refrigerator internal humidity sensor is provided on the vertical surface at a position higher than a vertical center of the vertical surface and lower than the outlet.

2. The refrigerator of claim 1, wherein the controller is configured to control the heaters to provide heat when the room temperature is in a first set temperature range and the flow of the cold air guided to the supply duct is blocked.

3. The refrigerator of claim 1, wherein the controller is configured to control the heaters to provide heat when the room temperature is in a first set temperature range and the compressor is stopped.

4. The refrigerator of claim 1, wherein the controller is configured to control the heaters to provide heat when the humidity detected by the refrigerator internal humidity sensor is higher than a first set humidity range and the flow of the cold air guided to the supply duct is blocked.

5. The refrigerator of claim 1, wherein the controller is configured to control the heaters to provide heat when the humidity detected by the refrigerator internal humidity sensor is higher than a first set humidity range and the compressor is stopped.

6. The refrigerator of claim 1, wherein the controller is configured to control the heaters to stop generating heat regardless of the room temperature when the humidity detected by the refrigerator internal humidity sensor is within a first set humidity range.

7. The refrigerator of claim 1, wherein the controller is configured to control the compressor and the damper such that cold air is supplied to one of the first or the second storage compartments having a relatively lower temperature among the first and second storage compartments when the one of the first or second storage compartments is maintained at a lower temperature range than that of the other one of the first or second storage compartments, and the damper is operated to block the flow of the cold air guided to the supply duct.

8. The refrigerator of claim 1, wherein the heaters comprise:

a first heater configured to provide heat to the damper; and a second heater configured to provide heat to the supply duct.

9. The refrigerator of claim 8, wherein the controller is configured to control at least one of the first heater or the second heater to generate heat when the at least one condition is satisfied.

10. The refrigerator of claim 1, wherein the one of the first or second storage compartments is maintained in a relatively high temperature range among the first and second storage compartments.

11. The refrigerator of claim 1, wherein one or more shelves are provided in the one of the first or the second storage compartments, and the refrigerator internal humidity sensor is positioned below an uppermost one of the one or more shelves provided in the one of the first or the second storage compartments.

12. A method of controlling an operation of a refrigerator, the method comprising:

performing a cooling operation to maintain each of a first storage chamber compartment and a second storage compartment in respective set temperature ranges while supplying or blocking cold air to at least any one of first or the second storage compartments by selectively opening or closing a supply duct through an operation of a damper and by controlling an operation of a compressor; and performing a defrosting operation for the damper to prevent freezing of the damper or to defrost the damper, when frozen, by controlling operations of one or more heaters configured to provide heat to at least one of the damper or the supply duct, wherein during the defrosting operation for the damper, the operations of the heaters are controlled on a basis of:

at least one of a room temperature or an internal humidity of at least one of the first or the second storage compartments, and an operation status of at least one of the compressor or the damper, and wherein one of the first or the second storage compartments includes a vertical surface having an outlet to receive cold air from the supply duct, and a sensor to detect the internal humidity is provided on the vertical surface at a position higher than a vertical center of the vertical surface and lower than the outlet.

13. The method of claim 12, further comprising determining a first condition to be satisfied and controlling at least one of the heaters to generate heat when the room temperature is maintained within a first set temperature range and a flow of cold air guided to the supply duct is blocked.

14. The method of claim 13, further comprising determining a second condition to be satisfied and controlling at least one of the heaters to generate heat when the room temperature is maintained within the first set temperature range and the compressor is stopped.

15. The method of claim 13, further comprising determining a third condition to be satisfied and controlling at least one of the heaters to generate heat when the internal humidity in at least one of the first or second storage compartments is higher than a first set humidity range and the flow of the cold air guided to the supply duct is blocked.

16. The method of claim 12, further comprising determining a fourth condition to be satisfied and controlling at least one of the heaters to generate heat when the internal humidity in at least one of the first or the second storage compartments is higher than a first set humidity range and the compressor is stopped.

17. The method of claim 12, further comprising determining a fifth condition to be satisfied and controlling at least one of the heaters to stop generating heat when the internal humidity in at least one of the first or the second storage compartments falls within a first set humidity range.

18. The method of claim 12, wherein performing the defrosting operation for the damper includes activating the heaters to generate heat when the internal humidity in at least one of the first or the second storage compartments is higher than a first set humidity range, the heaters being active to generate heat for a time period that becomes longer in proportion to a difference between the internal humidity and the first set humidity range.

* * * * *